US010830003B2

(12) United States Patent
Romer et al.

(10) Patent No.: US 10,830,003 B2
(45) Date of Patent: Nov. 10, 2020

(54) SIDE POCKET MANDREL FOR PLUNGER LIFT

(71) Applicants: Michael C. Romer, The Woodlands, TX (US); Tony W. Hord, Spring, TX (US)

(72) Inventors: Michael C. Romer, The Woodlands, TX (US); Tony W. Hord, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 25 days.

(21) Appl. No.: 16/396,294

(22) Filed: Apr. 26, 2019

(65) Prior Publication Data

US 2020/0032592 A1 Jan. 30, 2020

Related U.S. Application Data

(60) Provisional application No. 62/702,432, filed on Jul. 24, 2018.

(51) Int. Cl.
*E21B 43/12* (2006.01)
*E21B 17/00* (2006.01)

(52) U.S. Cl.
CPC ..... *E21B 17/00* (2013.01); *E21B 43/123* (2013.01)

(58) Field of Classification Search
CPC .... E21B 43/121; E21B 43/122; E21B 43/123; E21B 17/00
See application file for complete search history.

(56) References Cited

U.S. PATENT DOCUMENTS 3,799,259 A * 3/1974 Dinning ..... E21B 23/03 166/117.5
4,030,543 A * 6/1977 McGinn ..... E21B 23/03 166/117.5
4,976,314 A * 12/1990 Crawford ..... E21B 23/03 166/117.5
5,137,085 A * 8/1992 Goode ..... E21B 23/03 166/117.5

(Continued)

OTHER PUBLICATIONS

Luan, G. and He, S. (2012) "*A New Model for the Accurate Prediction of Liquid Loading in Low-Pressure Gas Wells*", Journal of Canadian Petroleum Technology, Nov. 2012, p. 493-498.

*Primary Examiner* — David Carroll
(74) *Attorney, Agent, or Firm* — ExxonMobil Upstream Research Company—Law Department

(57) ABSTRACT

A side pocket mandrel, including defining a tubular body having opposing ends and a bore formed within the tubular body. The tubular body comprises an eccentric portion such that a first inner diameter ($ID_1$) is formed at the opposing upper and lower ends, and a second larger inner diameter ($ID_2$) is formed along an eccentric portion. The mandrel includes a movable curtain disposed along the eccentric portion, wherein in a first position the movable curtain covers a portion of the eccentric portion above the pocket to provide a reduced inner diameter that approximates ($ID_1$), and in a second position the curtain is movable to a larger inner diameter ($ID_2$) that enables access by a kick-over tool to install a gas lift valve in or to retrieve the gas lift from the pocket. A method of producing hydrocarbon fluids is also provided.

30 Claims, 22 Drawing Sheets

(56) References Cited

U.S. PATENT DOCUMENTS

| | | | |
|---|---|---|---|
| 5,636,693 | A | 6/1997 | Elmer |
| 5,730,219 | A | 3/1998 | Tubel et al. |
| 7,490,675 | B2 | 2/2009 | Hearn |
| 2005/0072575 | A1 | 4/2005 | Yeo et al. |

* cited by examiner

SIDE POCKET MANDREL FOR PLUNGER LIFT

CROSS-REFERENCE TO RELATED APPLICATIONS

This application claims the benefits of U.S. Provisional Application 62/702,432, filed Jul. 24, 2018, the entirety of which is incorporated by reference herein.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to artificial lift systems for a producing wellbore. Further still, the invention relates to a side pocket mandrel as may be used in connection with a plunger lift operation for lifting wellbore fluids to the surface.

TECHNOLOGY IN THE FIELD OF THE INVENTION

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. In either instance, the final string of casing, referred to as a production casing, is also typically cemented into place.

To prepare the wellbore for the production of hydrocarbon fluids, a string of tubing is run into the casing. The tubing then becomes a string of production pipe through which hydrocarbon fluids flow from the reservoir and up to the surface.

Some wellbores are completed primarily for the production of gas (or compressible hydrocarbon fluids), as opposed to oil. Other wellbores initially produce hydrocarbon fluids, but over time transition to the production of gas. In either of such wellbores, the formation will frequently produce fluids in both gas and liquid phases. Liquids may include water, oil and condensate. At the beginning of production, the formation pressure is typically capable of driving the liquids with the gas up the wellbore and to the surface. Liquid fluids will travel up to the surface with the gas, through the production tubing, primarily in the form of entrained droplets.

During the life of the well, the natural reservoir pressure will decrease as gases and liquids are removed from the formation. As the natural downhole pressure of the well decreases, the gas velocity moving up the well drops below a so-called critical flow velocity. See G. Luan and S. He, A New Model for the Accurate Prediction of Liquid Loading in Low-Pressure Gas Wells, Journal of Canadian Petroleum Technology, p. 493 (November 2012) for a recent discussion of mathematical models used for determining a critical gas velocity in a wellbore. In addition, the hydrostatic head of fluids in the wellbore will work against the formation pressure and block the flow of in situ gas into the wellbore. The result is that formation pressure is no longer able, on its own, to force fluids from the formation and up the production tubing in commercially viable quantities.

In response, various remedial measures have been taken by operators. One option is to simply reduce the inner diameter of the production tubing a small amount, thereby increasing pressure. Operators have sought to monitor tubing pressure through the use of pressure gauges and orifice plates at the surface. U.S. Pat. No. 5,636,693 entitled "Gas Well Tubing Flow Rate Control," issued in 1997, disclosed the use of an orifice plate and a differential pressure controller at the surface for managing natural wellbore flow up more than one flow conduit. U.S. Pat. No. 7,490,675, entitled "Methods and Apparatus for Optimizing Well Production," also proposed the use of an orifice plate and a differential pressure controller to operate a control valve at the surface, but in the context of a plunger lift system.

A common technique for artificial lift in both oil and gas wells is the gas-lift system. Gas lift refers to a process wherein a gas (typically methane, ethane, nitrogen and related produced gas combinations) is injected into the wellbore downhole and then into the production tubing. This serves to reduce the density of the fluid column. Gas injection may be done through so-called gas-lift valves stacked vertically along the production tubing within the annulus. The injection of gas into the annulus, then through the valves, and then into the production tubing lightens the density of the wellbore fluids, reducing the hydrostatic head and decreasing the backpressure against the formation.

Multiple gas lift valves may be required to effectively "unload" production fluids. For gas lift operations, the injection rate is set by the operator at a continuous high level to ensure that fluids can travel to the surface, without regard to fluctuations in fluid densities or tubing pressure. Gas lift is frequently used for high-volume offshore wells, but is also enjoying a renaissance on land in connection with horizontal wells. This is primarily because of the ability of gas lift systems to manage entrained solids such as frac sand and scale. This is also because gas-lift wells do not experience the mechanical limitations that beam lift and electric submersible lift wells experience with non-vertical wells.

A related artificial lift technique that does not require continuous gas injection is referred to as plunger lift. Plunger lift production systems are typically used to deliquefy gas wells (or wells that are gas dominated). More specifically, the systems are used to unload relatively small volumes of liquid and any associated sands from the tubing, periodically carrying them to the surface. Plunger lift wells are typically used onshore.

Plunger lift systems employ a small cylindrical plunger which travels vertically along the production tubing within the wellbore. The cylindrical plunger is similar in form to a pipeline pig, but is designed to force the hydrostatic head up the wellbore and to the surface in response to a build-up of reservoir pressure. In operation, the metal cylinder, or "plunger," travels between the wellhead and a downhole bumper spring in a cyclic fashion.

The plunger provides a barrier that inhibits gas breakthrough and effectively carries a liquid slug to the surface. The differential pressure created by this action assists the well in lifting lighter liquids to the surface with lower gas velocities than those normally reached. This mitigates against the cost of installing a smaller-i.d. production tubing to increase the gas velocity.

In a plunger lift system, a specialized wellhead having a lubricator and a "catcher" is provided at the surface. The plunger will typically rest in the lubricator (or perhaps a pup joint) at the surface above the wellhead valves. The well is normally shut in to allow the plunger to fall to bottom. The lubricator can drop the plunger into the well on an as-needed basis, as determined by surface measurements and gauges. After a sufficient measured (or estimated) time, the well is allowed to produce again, causing the plunger to be raised back up to the surface along with the liquids. Stated another way, the plunger is forced back up the tubing by the accumulated pressure in the wellbore.

After the fluids are removed, gas will flow more freely from the formation into the wellbore for delivery to a gas distribution system such as a sales line at the surface. The production system is operated so that after the flow of gas from the well has again become restricted due to the further accumulation of fluids downhole, the valve is closed so that the plunger falls back down the tubing. Thereafter, the plunger is ready to lift another load of fluids to the surface upon the re-opening of the valve.

As the well continues to age, it is common that the cycle for dropping the plunger becomes longer and longer. This is due to the declining reservoir pressure available to operate the plunger. Shut-ins of several days or even a week may be required to build up enough pressure to return a plunger to the surface. At this point, the operator will consider alternative artificial lift methods to enable economic production volumes.

A relatively recent solution has been to combine plunger lift with gas lift. This is sometimes referred to as Gas-Assisted Plunger Lift, or "GAPL." With GAPL, gas is injected into the back side of the production tubing, creating enough pressure along with the reservoir below the plunger and enough gas velocity to assist the plunger and associated liquids in traveling up to the surface.

In GAPL, the operator typically will not include gas lift valves; rather, the lift gas is forced down the annulus and all the way to the bottom of the well, where it enters the bottom of the production tubing and then travels back up to the surface. Obviously, no packer is installed in the well completion. Some in the industry refer to this as "poor boy" gas lift.

Poor boy gas lifting is considered an inefficient process as there is little control over the injected gas rates at the lift point. Further, all gas is injected at the bottom of the well creating a potentially undesirable build-up of well pressure. Conventional gas lift mandrels can be installed in the tubing string to improve efficiency and to incorporate "standard" gas lift principles. In this instance, conventional mandrels may optionally be welded to the outer diameter of the production tubing with integral gas lift valves such that the tubing I.D. is minimally affected. Plungers can operate as designed in both the poor-boy and the conventional mandrel configurations since there are no changes to the internal dimensions of the production tubing.

A drawback to the use of conventional mandrels during GAPL is that the tubing must be pulled to replace the gas lift valves. This is because there is no way to access the valves from the tubing I.D. This is an expensive operation that requires a workover rig to be brought out to the well site.

Therefore, it is desirable to be able to use side pocket mandrels since side pocket mandrels allow access to gas lift valves using a wireline through the tubing I.D. This is particularly beneficial during offshore operations. However, the side pocket mandrel access points are large, creating changes in the inner diameter flow path. The result is that a plunger would not be able to transit across a side pocket mandrel.

Accordingly, a need exists for a side pocket mandrel that is configured for use in connection with a plunger lift operation. A need further exists for a method of artificial lift that combines plunger lift with gas lift and that reduces the cost for accessing the gas lift valves for installation.

BRIEF SUMMARY OF THE DISCLOSURE

A side pocket mandrel is first provided herein. The side pocket mandrel is designed to be threadedly connected in series to a string of production tubing. The production tubing, in turn, is run into a hydrocarbon-producing wellbore.

The mandrel first comprises a tubular body. The tubular body has an upper end, an opposing lower end, and a bore formed within the tubular body extending from the upper to the lower end. The tubular body comprises an eccentric portion residing between the upper and lower ends such that a first inner diameter ($ID_1$) is formed at the opposing upper and lower ends, and a second larger inner diameter ($ID_2$) is formed along the eccentric portion. The eccentric portion has a centerline that is offset from a centerline of the tubing.

The mandrel further comprises a tubular pocket, or "receiver." The tubular pocket resides within the eccentric portion of the tubular body and is dimensioned to slidably and sealingly receive a gas lift valve. This is done by means of a kick-over tool which is run into the wellbore by means of a wireline.

Typically, a length of the pocket is less than a length of the eccentric portion. This creates an open area within the eccentric portion above the pocket. The open area is configured to receive the gas lift valve during an installation or retrieval procedure.

The mandrel includes ports. The ports reside adjacent the pocket and place the gas lift valve in fluid communication with the annulus of the wellbore when the side pocket mandrel is run down hole.

The side pocket mandrel further comprises a movable curtain. The movable curtain is disposed along the eccentric portion. In a first position ($P_1$), the movable curtain covers the open area of the eccentric portion above the pocket. This also creates a reduced inner diameter that approximates ($ID_1$). In a second position ($P_2$), the movable curtain is movable to create a larger inner diameter that approximates ($ID_2$). ($ID_2$) enables access by the kick-over tool above the pocket to selectively install the gas lift valve in, or to retrieve the gas lift from, the pocket.

In a preferred embodiment, the side pocket mandrel is used in conjunction with a so-called Gas-Assisted Plunger Lift operation. Thus, in its ($P_1$) position, the movable curtain is uniquely dimensioned and configured to allow a metal cylinder used as part of a plunger lift system to pass along the side pocket mandrel without catching on the pocket.

In one aspect, the upper end of the tubular body comprises an orienting sleeve. The orienting sleeve resides at an upper end of the side pocket mandrel. The orienting sleeve is provided with a longitudinal orienting slot having a downwardly facing shoulder at the upper end thereof. The orienting sleeve is provided with a pair of downwardly facing guide surfaces which guide the kick-over tool towards the slot.

The orienting sleeve is integral to the inner diameter of the tubular body, and is configured to catch a guide key of the kick-over tool when the kick-over tool is raised across the side pocket mandrel. In this way, the kick-over tool is properly oriented towards the eccentric portion, above the pocket.

In one embodiment, the pocket is positioned within the eccentric portion such that an open area is also left below the pocket. In this instance, the side pocket mandrel may also comprise a stationary curtain. The stationary curtain is disposed along the open area below the pocket, wherein an upper end of the stationary curtain is adjacent to a bottom of the pocket while a lower end of the stationary curtain is fixed to a lower end of the tubular body, thereby reducing the inner diameter of the open area below the pocket to approximately ($ID_1$).

An artificial lift system for a wellbore is also provided herein. In this invention, the wellbore has a tubing string therein for conveying production fluids up to the surface. The artificial lift system first comprises a plunger lift system. The plunger lift system may be any known plunger lift system used for assisting in the production of hydrocarbon fluids. Such a system will include a cylinder. The cylinder is dimensioned to travel through the production tubing, up and down, cyclically in response to pressure differential.

The plunger lift system will also include a lubricator. The lubricator is positioned over the well head. The lubricator will have an associated plunger catcher for holding the cylinder when it is lifted to the surface, and then releasing it again in accordance with instructions from a timer or controller at the surface.

The plunger lift system will further have a bumper. Typically, the bumper is a spring residing in the production tubing proximate a bottom of the vertical portion of the wellbore. The bumper is configured to receive the cylinder when it gravitationally travels towards the bottom of the wellbore upon being released by the plunger catcher.

The artificial lift system also comprises at least two side pocket mandrels. Each mandrel is configured in accordance with any of the embodiments described above. The side pocket mandrels are disposed along the production tubing using threaded connections. In addition, the pocket of each side pocket mandrel holds (or is configured to hold) a gas lift valve.

A method of producing hydrocarbon fluids from a wellbore is also provided herein. The wellbore comprises a wellhead at a surface, and at least one string of casing extending down from the wellhead. The wellbore has been formed for the purpose of producing hydrocarbon fluids to the surface in commercially viable quantities. Typically, the well will produce primarily hydrocarbon fluids that are compressible at surface conditions, e.g., methane and ethane, but there will likely also be at least some hydrocarbon liquids, albeit in diminishing quantities.

The method first comprises running a string of production tubing into the wellbore. The string of production tubing comprises a series of tubing joints threadedly connected end-to-end. The production tubing will also include at least two side pocket mandrels threadedly connected along the production tubing.

The side pocket mandrels are configured in accordance with any of the embodiments described above. Of importance, the pocket of each side pocket mandrel will contain a gas lift valve that is in fluid communication with the annulus formed between the production tubing and the surrounding casing.

The method also includes producing hydrocarbon fluids from a subsurface reservoir, through the production tubing, and up to the wellhead at the surface.

Preferably, in its ($P_1$) position, the movable curtain is dimensioned and configured to allow a metal cylinder used as part of a plunger lift system to pass along the side pocket mandrel without catching on the pocket. The method then further comprises:

releasing the metal cylinder from a lubricator disposed over the wellhead into the wellbore; and allowing the metal cylinder to gravitationally fall to the bumper spring positioned along the production tubing below the at least two side pocket mandrels.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 1E shows a step where the gas lift mandrel is lowered into the pocket (or "receiver") of the side pocket mandrel.

FIG. 3A is the same as FIG. 1H.

FIG. 3E shows a step where a pivot arm on the kick-over tool is lowered into the pocket (or "receiver") of the side pocket mandrel. The pivot arm latches onto the gas lift valve.

FIG. 3H is the same as FIG. 3A, except the gas lift valve has been unseated.

FIG. 5E shows a step where the gas lift valve is lowered into the pocket (or "receiver") of the side pocket mandrel.

FIG. 6E shows a step where the gas lift mandrel is lowered into the pocket (or "receiver") of the side pocket mandrel.

DETAILED DESCRIPTION OF CERTAIN EMBODIMENTS

Definitions

Figure 1A:
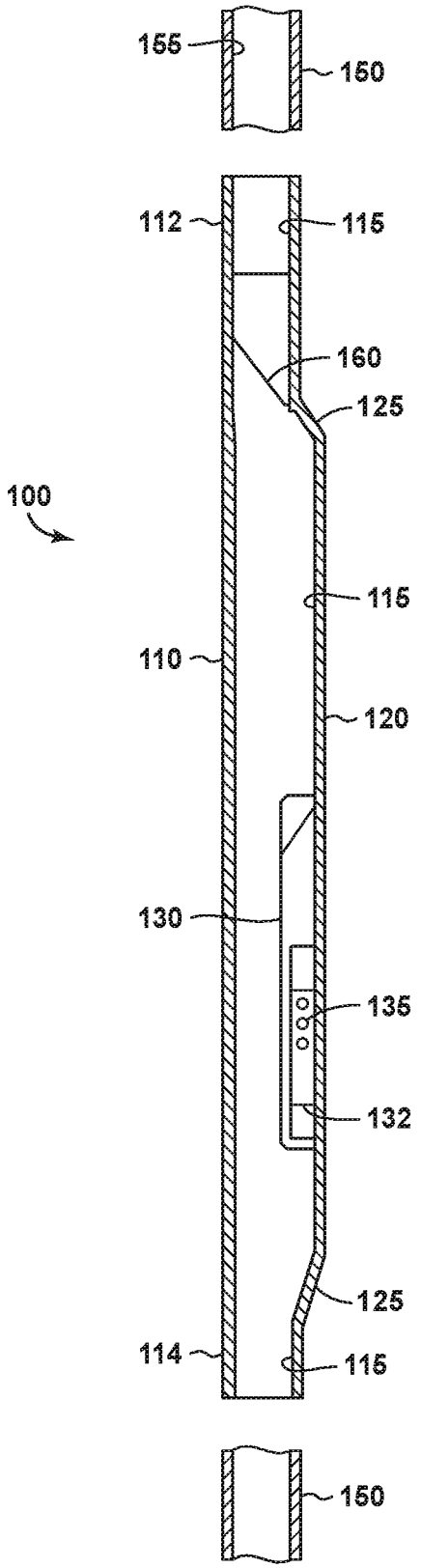
FIG. 1A (Prior Art)
FIG. 1A is a schematic side view of a known side pocket mandrel. The mandrel is intended to be threadedly connected to a string of production tubing within a wellbore. A portion of a production tubing is illustrated above and below the side pocket mandrel.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase. A gas may be referred to herein as a "compressible fluid." In contrast, a fluid that is in its liquid phase is an "incompressible fluid."

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore." The term "bore" refers to the diametric opening formed in the subsurface by the drilling process.

Description of Selected Specific Embodiments

FIG. 1A is a side view of a known side pocket mandrel 100. The side pocket mandrel 100 defines a tubular body 110 that is intended to be threadedly connected, in series, to a string of production tubing 150. It is understood that the production tubing 110 is made up of a long series of tubing joints threadedly connected while being run into a wellbore (shown at 400A in FIG. 4A).

It is also understood that the wellbore exists for the purpose of producing hydrocarbon fluids from subsurface reservoir, or "pay zone." In one aspect, the wellbore produces primarily gas, with diminishing liquid production and diminishing reservoir pressure. In one aspect, produced fluids may have a GOR in excess of 500 or, more preferably, above 3,000. In any event, production fluids are intended to flow from the reservoir, up the production tubing 150, past the mandrel 100, and on up to the surface.

The tubular body 110 comprises a wall that forms a bore 115. The bore 115 is in fluid communication with a bore 155 of the production tubing 110. The tubular body 110 also includes an upper end 112 and a lower end 114. The bore 115 extends from the lower 114 to the upper 112 end.

The side pocket mandrel 120 includes upper and lower shoulders 125. The shoulders 125 form an eccentric portion 120 of the body 110. The eccentric portion 120 forms an enlarged outer diameter portion. In this respect, the upper 112 and lower 114 ends have an inner diameter ($ID_1$) while the eccentric portion 120 has a larger inner diameter ($ID_2$).

The eccentric portion 120 holds an elongated barrel, or "pocket" 130. The pocket 130 is dimensioned to receive a gas lift valve. For this reason the pocket is sometimes referred to as a "receiver." An illustrative gas lift valve is shown at 140 in FIGS. 1B through 1H.

The pocket 130 includes one or more ports 135. The ports 135 are in fluid communication with an annulus formed between the production tubing 150 and a surrounding string of casing (shown at 410 of FIG. 4A) within the wellbore. In this way, gas that is injected behind the production tubing 150 may flow through the ports 135, into the pocket 130, and into the gas lift valve 140. From there, gas is controllably released into the bore 155 of the production tubing 150 as part of a gas lift operation.

The pocket 130 also includes one or more seating nipples 132. The seating nipples 132 are dimensioned to frictionally receive and hold a gas lift valve 140 within the pocket 130. In FIG. 1A, the pocket 130 is empty, meaning that it has not yet received a gas lift valve 140.

Figure 1B:
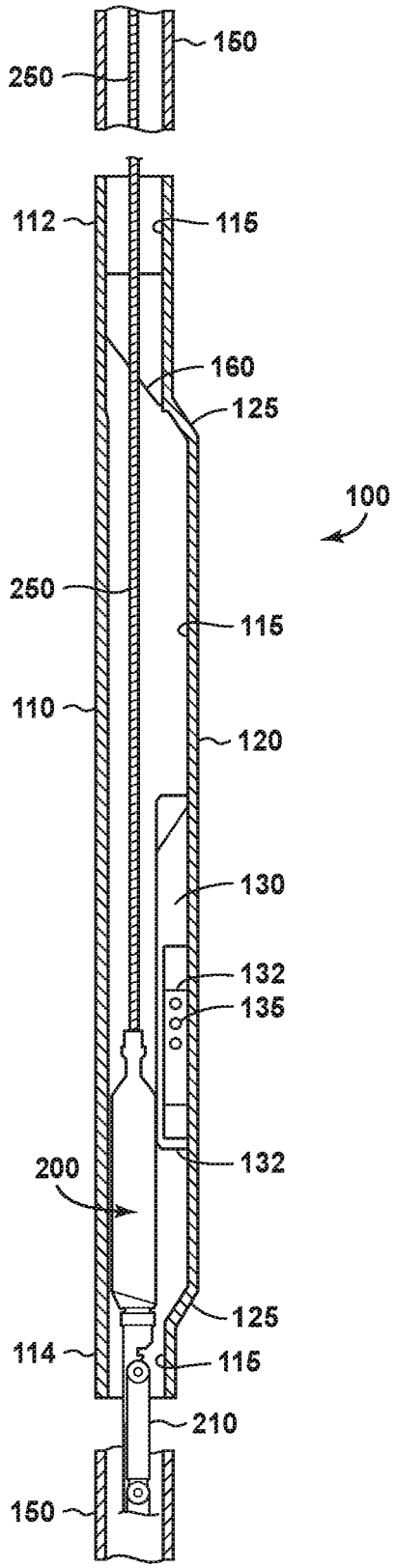
FIG. 1B (Prior Art)
FIG. 1B is a side view of the side pocket mandrel of FIG. 1A. Here, a so-called kick-over tool has been run into the production tubing and then partially past the side pocket mandrel. A wireline is shown as a working string for the kick-over tool.

In order to deliver a gas lift valve 140 to the pocket 130, a so-called kick-over tool is used. The kick-over tool is run into the wellbore on a wireline 250. FIG. 1B is a side view of the side pocket mandrel 100 of FIG. 1A. In this view, a portion of a kick-over tool 200 is shown. The kick-over tool 200 is lowered to a depth of the side pocket mandrel 100. The depth of the mandrel 100 is known from well records.

Figure 2:
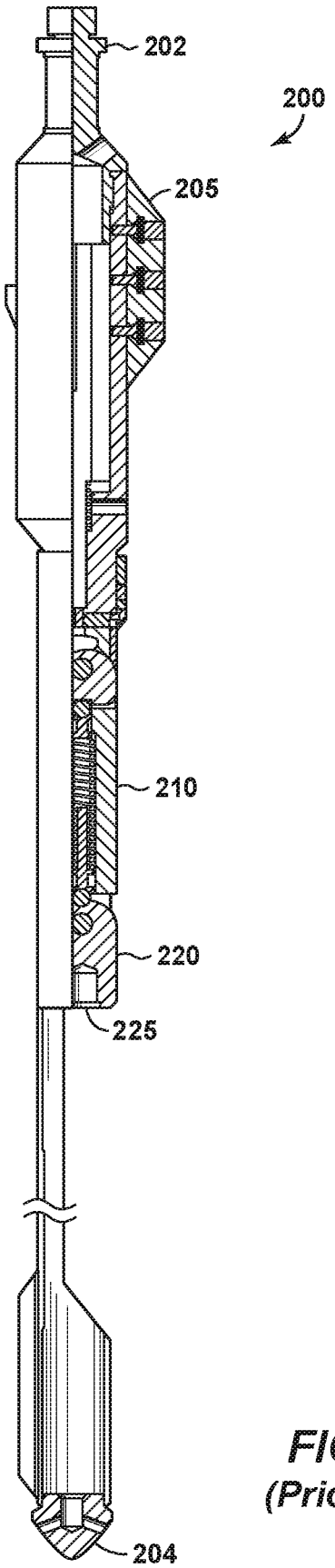
FIG. 2 (Prior Art)
FIG. 2 is a side view of a known kick-over tool as may be used to install or retrieve a gas lift valve.

FIG. 2 is an enlarged cut-away view of the kick-over tool 200. The illustrative kick-over tool 200 is the McMurry-Macco KOT tool offered by Weatherford Technology Holdings, LLC of Houston, Tex. In general, kick-over tools may be used for the installation (or retrieval) of flow devices for downhole applications. Such applications may include chemical injection, waterflood and corrosion monitoring. In the present application, the kick-over tool 200 is intended for the installation and retrieval of a gas lift valve, and particularly for a gas lift valve 140 residing in a side pocket mandrel 130.

The kick-over tool 200, or "KOT", has a top end 202 and a bottom end 204. The top end 202 is connected to the wireline 250 by means of a standard wireline run-in connection (not shown). The bottom end 204 is simply a stabber designed to avoid hanging up on the pocket 130 during run-in.

The KOT 200 operates with a pivot arm 210. The pivot arm 210 is designed to kick out when tension is applied to a guide key 205. A valve connector 220 is linked to the pivot arm 210. The valve connector 220 provides a frictional connection 225 with an upper end of a gas lift valve 140.

Returning to FIG. 1B, it is understood that the kick-over tool 200 is running a gas lift valve into the production tubing 150. In this view, the kick-over tool 200 has intentionally over-shot the side pocket mandrel 100, meaning that the gas lift valve is not visible. In order to run the kickover tool 200 into the wellbore, the kick-over tool 200 is made up onto the bottom of the wireline tool string 250. The assembly is then placed in a lubricator (not shown) at the surface for launch.

Figure 1C:
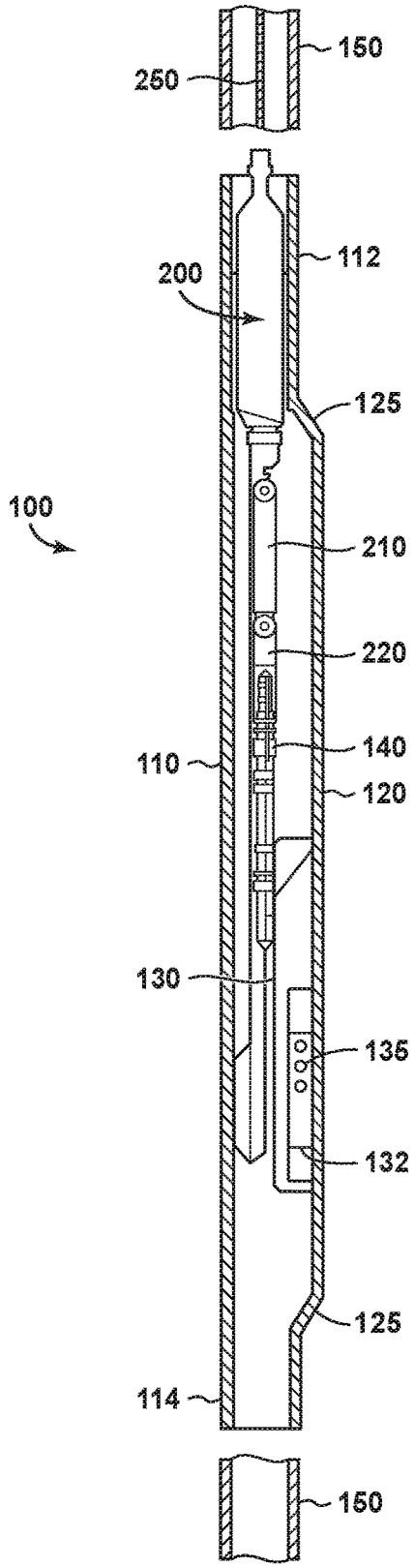
FIG. 1C (Prior Art)
FIG. 1C shows another view of the side pocket mandrel of FIG. 1A. In this view, the kick-over tool has been raised up the wellbore. It can be seen that a gas lift valve is connected to a pivot arm of the kick-over tool.

FIG. 1C is another side view of the side pocket mandrel 100 of FIG. 1A. Here, the kick-over tool 200 is being slowly pulled back up the bore 115 of the side pocket mandrel 100. The KOT 200 includes a guide key 205. The guide key 205 will make contact with an orienting sleeve 160. The orienting sleeve 160 is integral to the bore 115 of the tubular body 110, and serves as a guide surface for the guide key 205.

The key 205, upon engaging one of the guide surfaces, will follow the guide surface, causing the KOT 200 to rotate about its longitudinal axis until the guide key 205 becomes aligned with and enters the orienting slot. When the guide key 205 is in the orienting slot, the KOT 200 is properly oriented in the side pocket mandrel 100 with respect to the side pocket bore 120. Additionally, when the kick-over tool 200 stops, this indicates to the operator at the surface that the guide key 205 has contacted the slot at the top of the orienting sleeve 160.

Figure 1D:
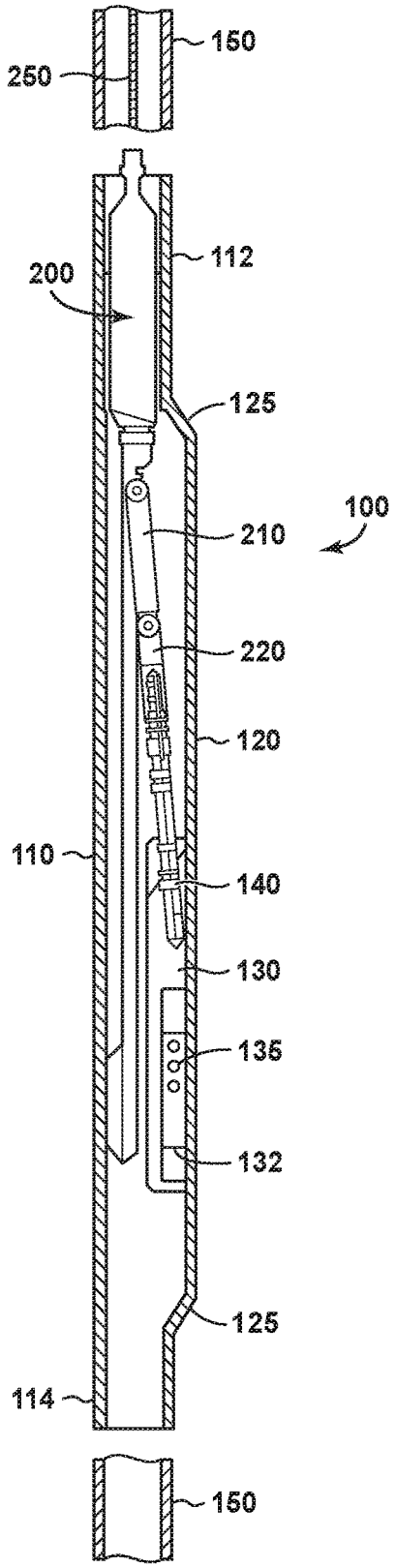
FIG. 1D (Prior Art)
FIG. 1D is still another view of the side pocket mandrel of FIG. 1A. Here, the kick-over tool has been actuated. This is in response to a guide key of the kick-over tool catching on a slot within an orienting sleeve of the side pocket mandrel.

FIG. 1D is still another side view of the side pocket mandrel 100 of FIG. 1A. Here, tension is being pulled on the wireline 250, causing the kick-over tool 200 to rotate into proper alignment. At the surface, tension is pulled until the weight indicator of the wireline unit indicates that enough weight is being applied to actuate the kick-over tool 200 to cause it to "kick out" into the bore of the eccentric portion 120. When this occurs, the gas lift valve 140 will be positioned over the pocket 130.

Figure 1E:
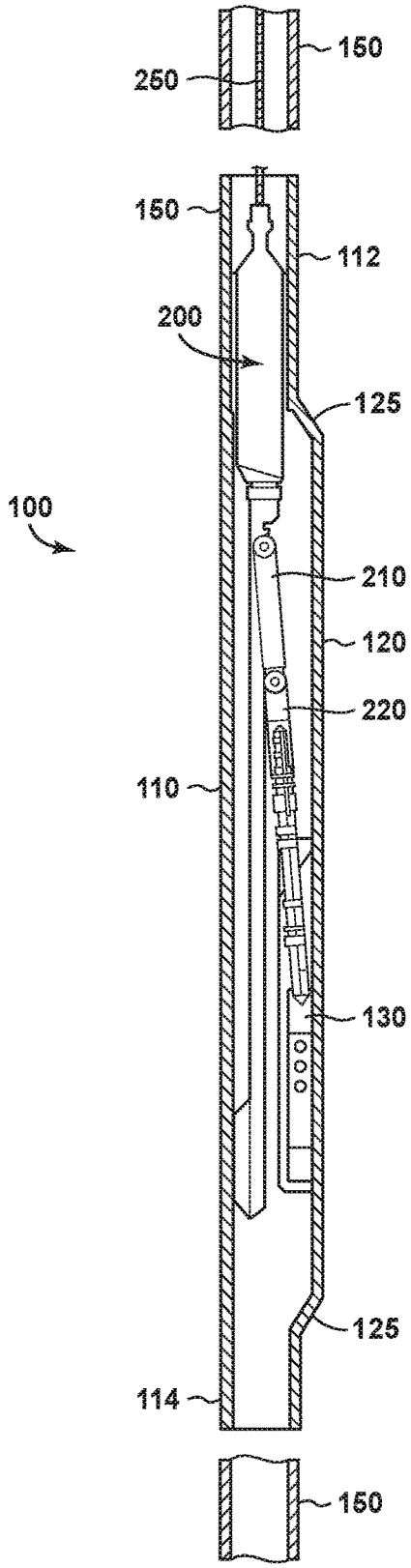
FIG. 1E (Prior Art)
FIG. 1E is yet another side view of the side pocket mandrel of FIG. 1A.

FIG. 1E is yet another side view of the side pocket mandrel 100 of FIG. 1A. Here, the kick-over tool 200 is lowered back down the bore 115 of the side pocket mandrel 100. Simultaneously, the connected gas lift valve 140 is lowered into the pocket 130. The operator will know that the gas lift valve has hit the pocket 130 when a weight loss is registered on the weight indicator. Of interest, if no weight loss is registered, this will indicate that the kick-over tool 200 did not release to its kicked over position and the gas lift valve 140 has missed the pocket 130. In this case, the steps of FIGS. 1B, 1C and 1D are repeated.

Figure 1F:
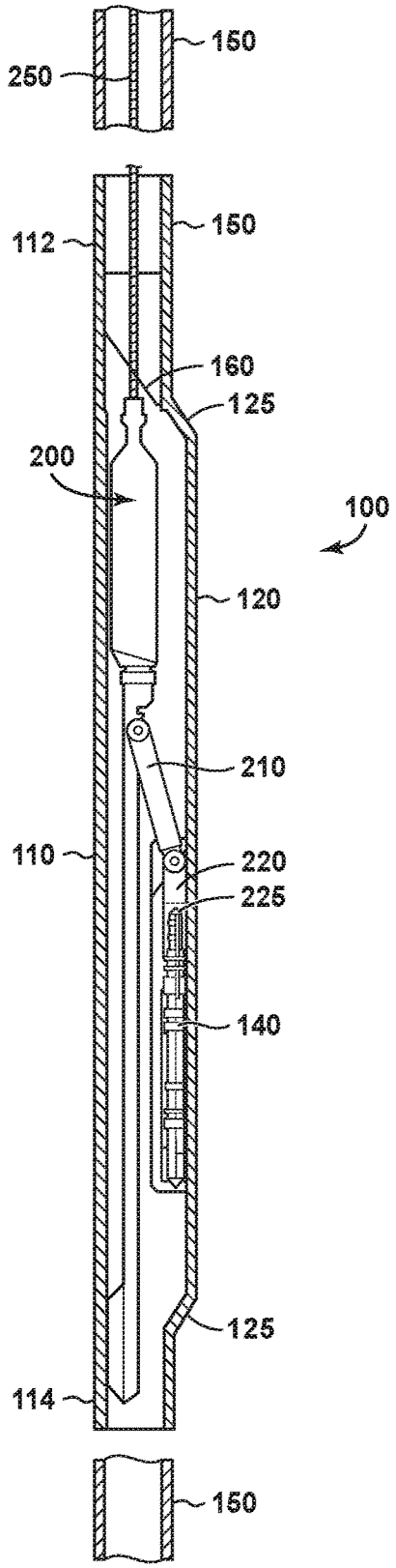
FIG. 1F (Prior Art)
FIG. 1F provides another side view of the side pocket mandrel of FIG. 1A. In this step, the gas lift valve has been seated into the pocket of the side pocket mandrel.

FIG. 1F is another side view of the side pocket mandrel 100 of FIG. 1A. Here, the gas lift valve 140 is jarred into position within the pocket 130. This is done by the operator quickly releasing tension on the wireline 250, reducing weight on the weight indicator to "0." The gas lift valve 140 is seated in the seating nipples 132.

Figure 1G:
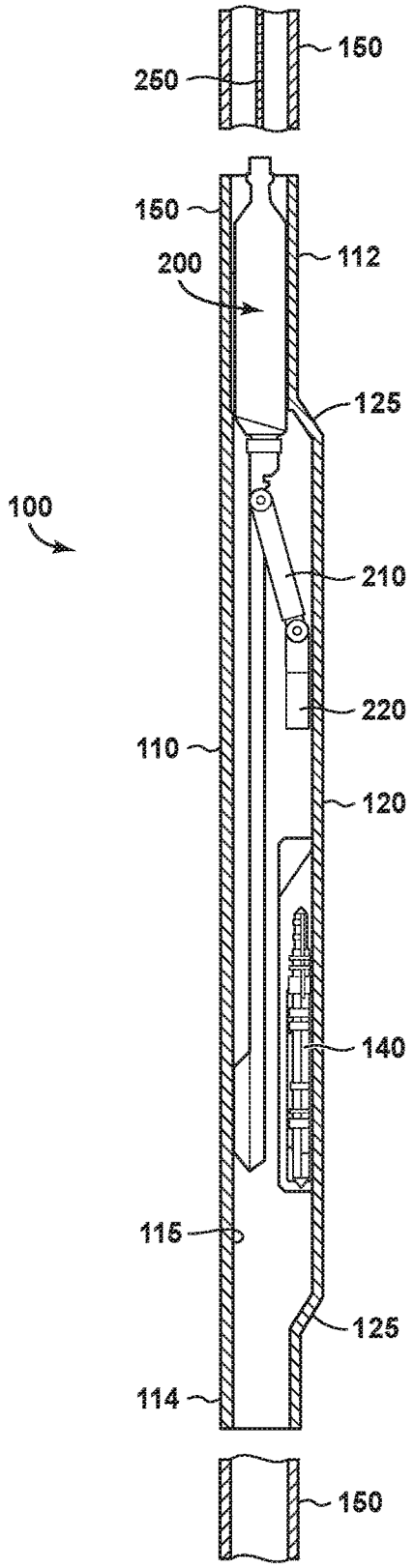
FIG. 1G (Prior Art)
FIG. 1G is still another side view of the side pocket mandrel of FIG. 1A. Here, the frictional connection between the pivot arm connector and the gas lift valve. has been released.

FIG. 1G is still another side view of the side pocket mandrel 100 of FIG. 1A. In this view, the kick-over tool 200 is raised. The guide key 205 associated with the kick-over tool 200 catches in the orienting sleeve 160, allowing the wireline 250 and connected kick-over tool 200 to "hang up" in the wellbore. The operator then jars upward on the kick-over tool 200. This is done by rapidly applying tension to the wireline 250, up to a designated weight. This will cause a frictional run-in connection to become disconnected, releasing the KOT 200 from the gas lift valve 140.

It is observed that so-called KOT series tools do not require pinning between runs during running and pulling procedures. When the tool 200 is retrieved through the top 112 of the side-pocket mandrel 100, the arm assembly 210 is pushed back into a run-in position. This quick re-cock feature greatly reduces wireline time by eliminating the need to remove the tool from the tool string for disassembly and re-pinning. It also allows the operator several attempts to either set or retrieve the gas lift valve 140 without pulling out of the well.

Figure 1H:
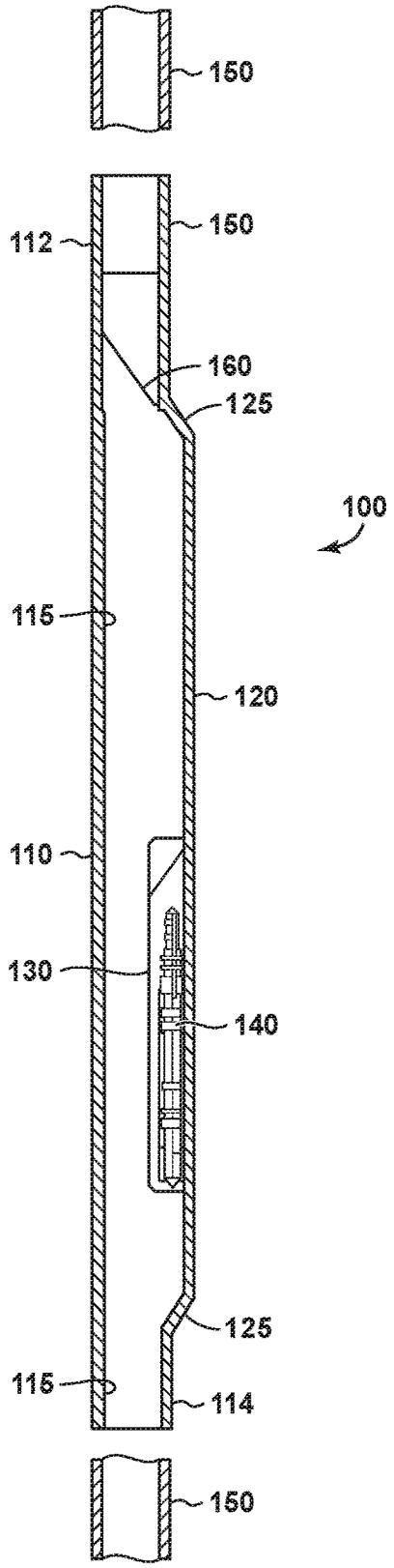
FIG. 1H (Prior Art)
FIG. 1H is a final side view of the side pocket mandrel of FIG. 1A. The view of FIG. 1H is the same as FIG. 1A, except the gas lift valve now resides in the pocket of the side pocket mandrel, ready for use in a gas lift operation.

FIG. 1H is a final side view of the side pocket mandrel 100 of FIG. 1A. The kick-over tool 200 has been removed from the side pocket mandrel 100 and is being pulled up to the lubricator.

Figure 3A:
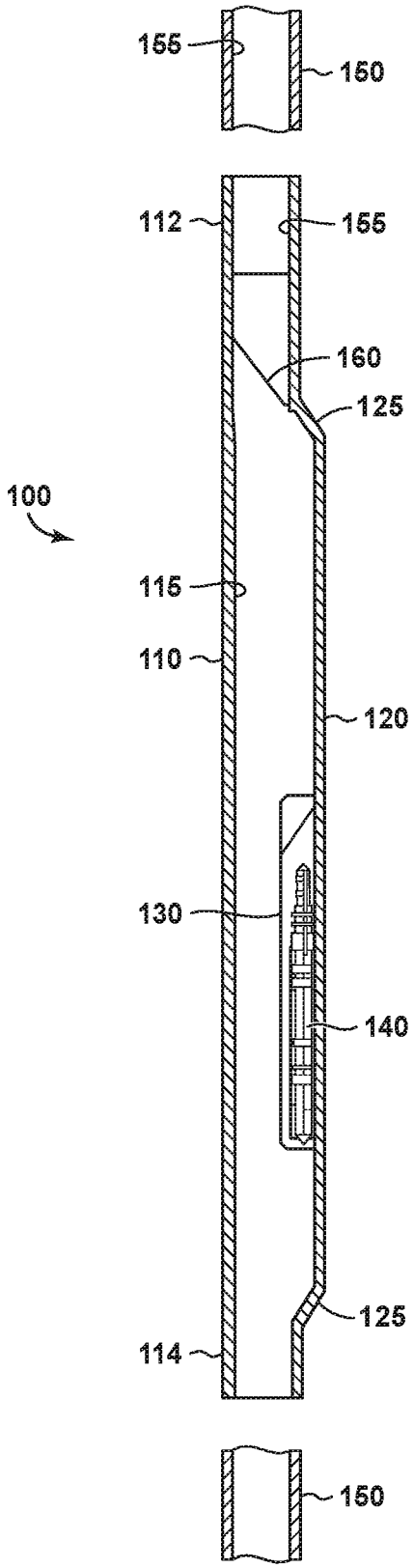
FIG. 3A (Prior Art)
FIG. 3A is a schematic side view of the side pocket mandrel of FIG. 1A. In this view, the gas lift valve is seated in the pocket of the side pocket mandrel. Thus.

It is incidentally observed that the same kick-over tool 200 may be used to retrieve the gas lift valve 100 back from the pocket 130. FIG. 3A is a side view of the gas lift valve 140, residing within a pocket 130. (This is actually the same view as FIG. 1H.) The pocket 130, again, is part of the side pocket mandrel 100.

Figure 3B:
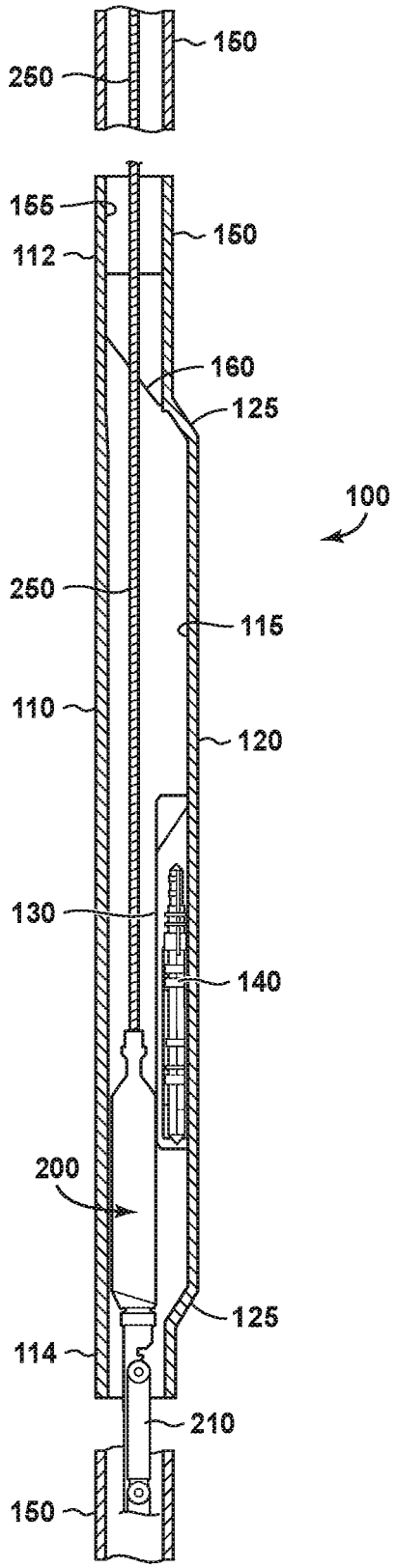
FIG. 3B (Prior Art)
FIG. 3B is a side view of the side pocket mandrel of FIG. 3A. Here, the kick-over tool has been run back into the production tubing, and then partially past the side pocket mandrel. A wireline is again shown as a working string for the kick-over tool.

FIG. 3B is another side view of the gas lift mandrel 100 of FIG. 3A. In this view, a portion of the kick-over tool 200 is again shown. The kick-over tool 200 has been lowered to a depth of the side pocket mandrel 100. The KOT 200 is again made up onto the bottom of the wireline tool string and then placed in the lubricator for launch from the surface. In this case, the KOT 200 does not have an attached gas lift valve; rather, the kick-over tool 200 will be used to latch onto the gas lift valve 140 (shown in FIG. 3E) using the connector 225.

Figure 3C:
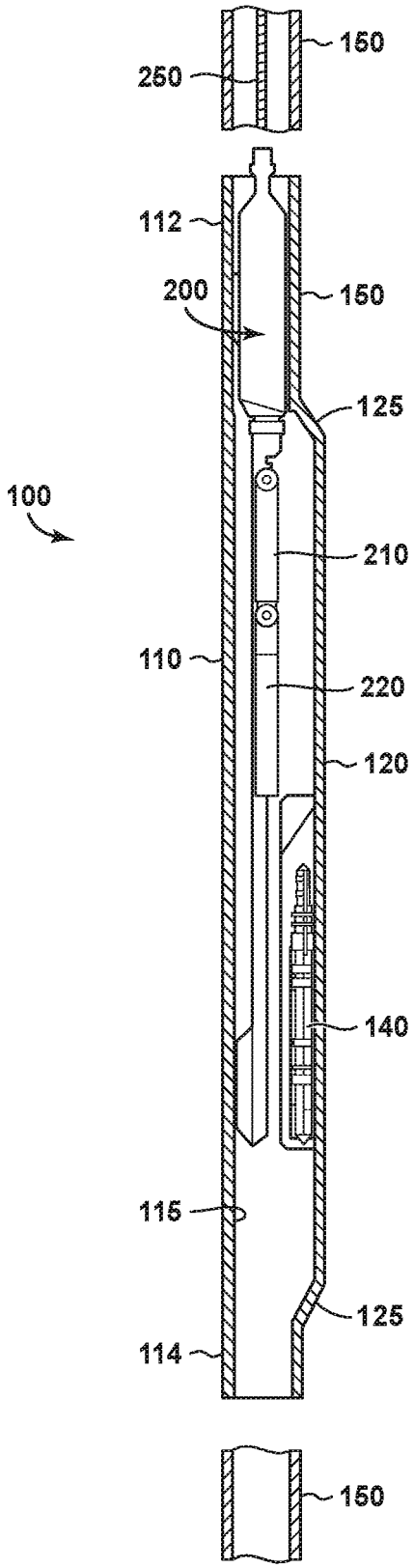
FIG. 3C (Prior Art)
FIG. 3C shows another view of the side pocket mandrel of FIG. 3A. In this view, the kick-over tool has been raised up the wellbore.

FIG. 3C is still another side view of the gas lift mandrel 100 of FIG. 3A. Here, the kick-over tool 200 is being slowly pulled back up the side pocket mandrel 100 and against the orienting sleeve 160. This again aligns the pivot arm 210 with the pocket 130. When the KOT 200 stops, this indicates to the operator at the surface that the locating finger has contacted the top of the orienting sleeve 160 and the pivot arm 210 is in position.

Figure 3D:
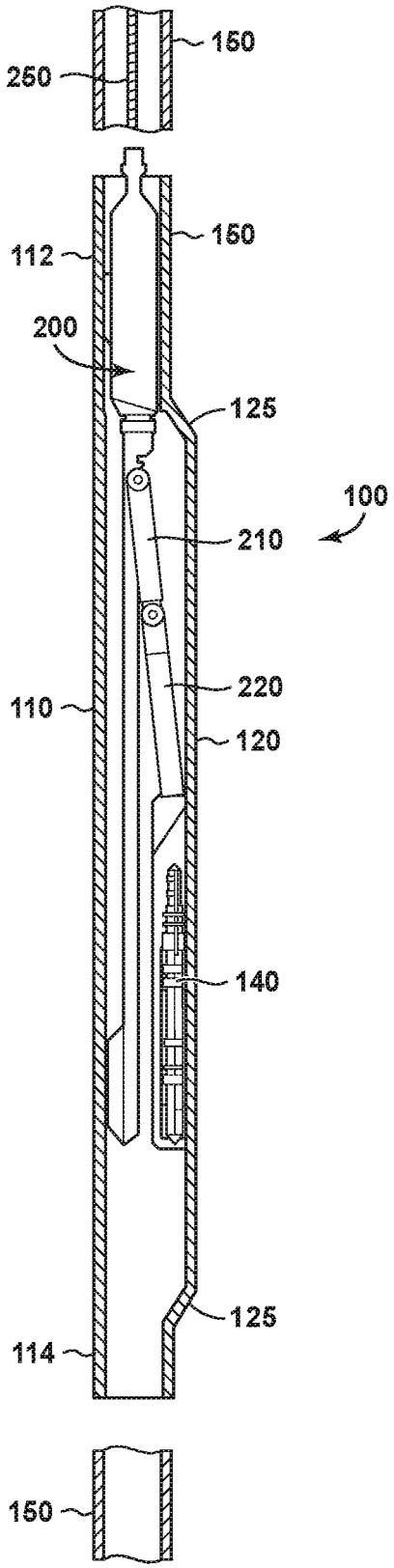
FIG. 3D (Prior Art)
FIG. 3D is still another view of the side pocket mandrel of FIG. 3A. Here, the kick-over tool has been actuated. This is in response to a guide key catching on the slot within an orienting sleeve of the side pocket mandrel.

FIG. 3D is yet another side view of the gas lift mandrel 100 of FIG. 3A. Here, tension is being pulled on the wireline 250, causing the kick-over tool 200 to rotate into proper alignment. Tension is pulled from the surface until the weight indicator of the wireline unit indicates that enough weight is being applied to actuate the kick-over tool 200 to its kicked over position.

Figure 3E:
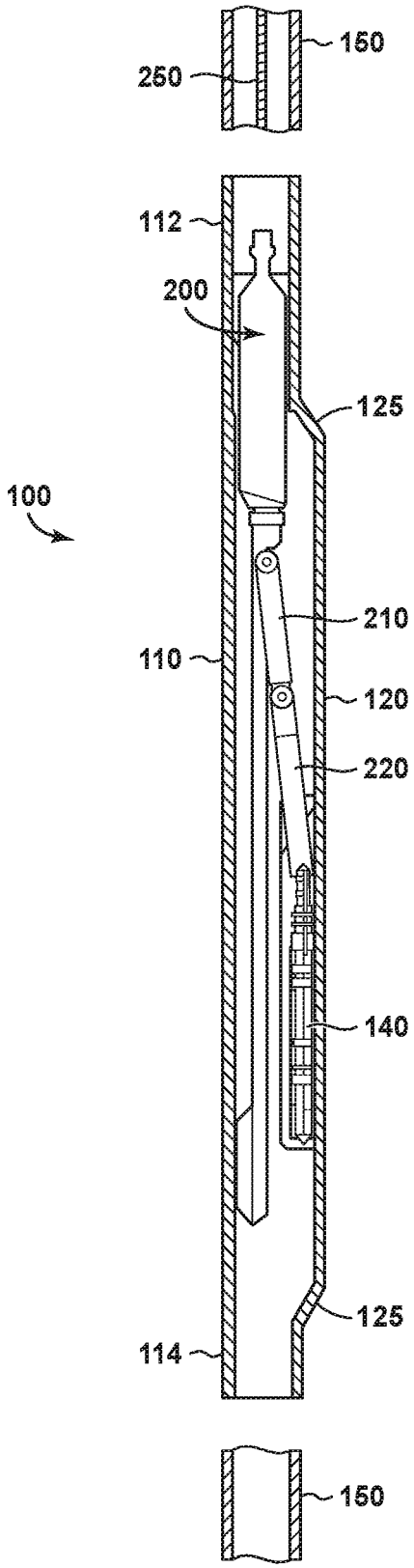
FIG. 3E (Prior Art)
FIG. 3E is yet another side view of the side pocket mandrel of FIG. 3A.

FIG. 3E is still another side view of the gas lift mandrel 100 of FIG. 3A. Here, the kick-over tool 200 is lowered back down the bore 115 of the side pocket mandrel 100. The operator will know that the kick-over tool 200 has landed on the gas lift valve 140 within the pocket 130 when a weight loss is registered on the weight indicator.

Figure 3F:
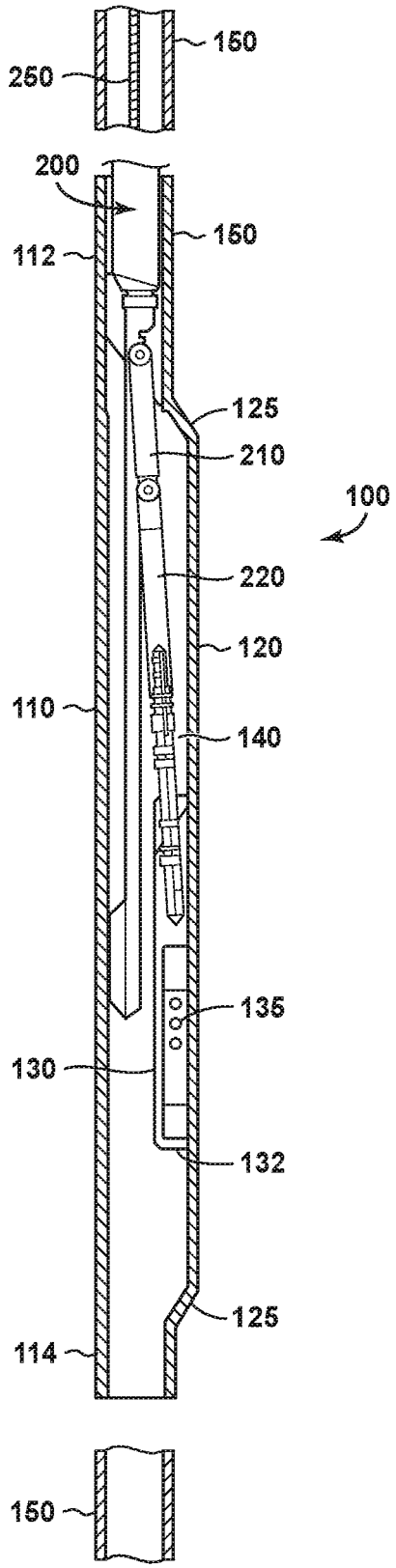
FIG. 3F (Prior Art)
FIG. 3F provides another side view of the side pocket mandrel of FIG. 3A. In this step, the gas lift valve has been unseated from the pocket of the side pocket mandrel.

FIG. 3F is still another side view of the gas lift mandrel 100 of FIG. 3A. Here, the kick-over tool 200 is jarred down onto the gas lift valve 140 within the pocket 130. This is done by the operator slightly raising the wireline 250, and then quickly releasing tension on the wireline 250, reducing weight on the weight indicator to "0."

Figure 3G:
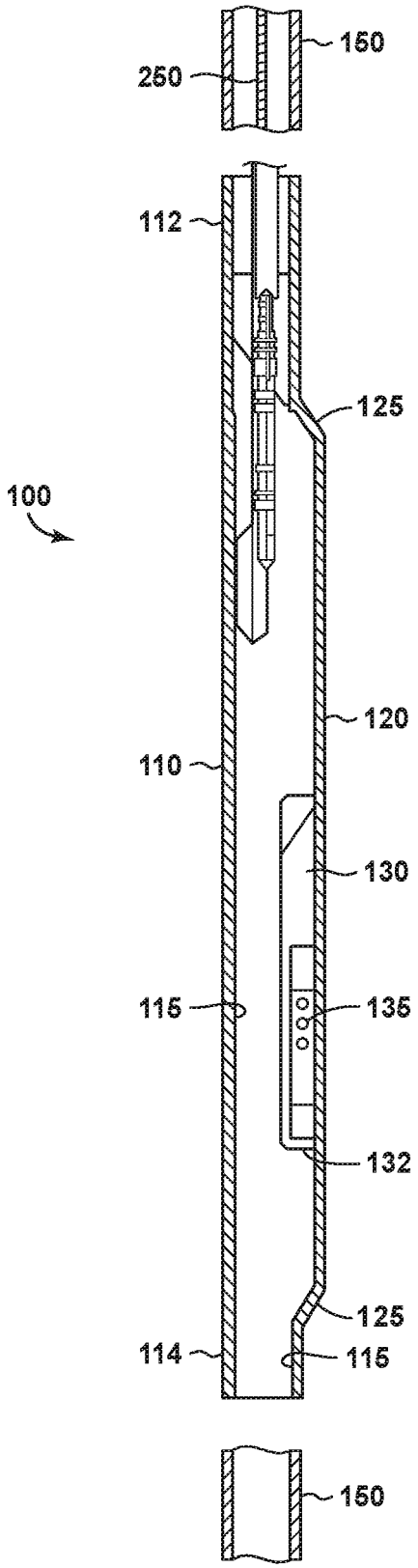
FIG. 3G (Prior Art)
FIG. 3G is still another side view of the side pocket mandrel of FIG. 3A. Here, the pivot arm assembly is folded back into its run-in position.

FIG. 3G is still another side view of the gas lift mandrel 100 of FIG. 3A. In this view, the kick-over tool 200 and attached gas lift valve 140 are raised. The guide key 205 associated with the kick-over tool 200 catches in the orienting sleeve 160, allowing the wireline 250 and connected kick-over tool 200 to "hang up" in the wellbore. The operator then jars upward on the kick-over tool 200. This is done by rapidly applying tension to the wireline 250, up to a designated weight. The pivot arm 210 will collapse into and re-latch to its run-in position.

Figure 3H:
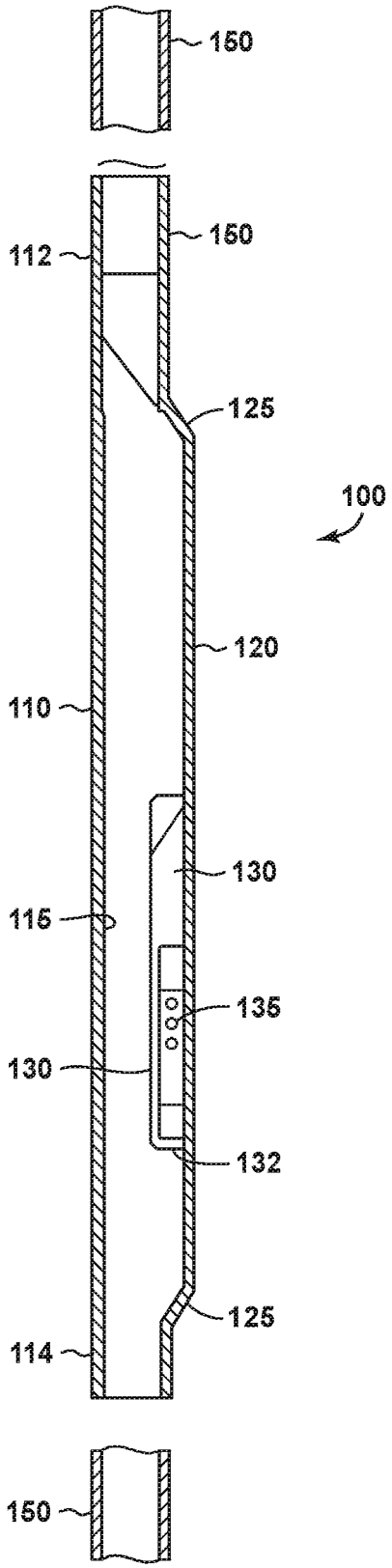
FIG. 3H (Prior Art)
FIG. 3H is a final side view of the side pocket mandrel of FIG. 3A. The kick-over tool and connected gas lift valve have been removed from the wellbore.

FIG. 3H is still another side view of the gas lift mandrel 100 of FIG. 3A. Here, the wireline 250 and connected kick-over tool 200 and gas lift valve 140 are no longer seen as they are being pulled up the production tubing 150 and to the surface. FIG. 3H is actually the same view as FIG. 1A.

Figure 4A:
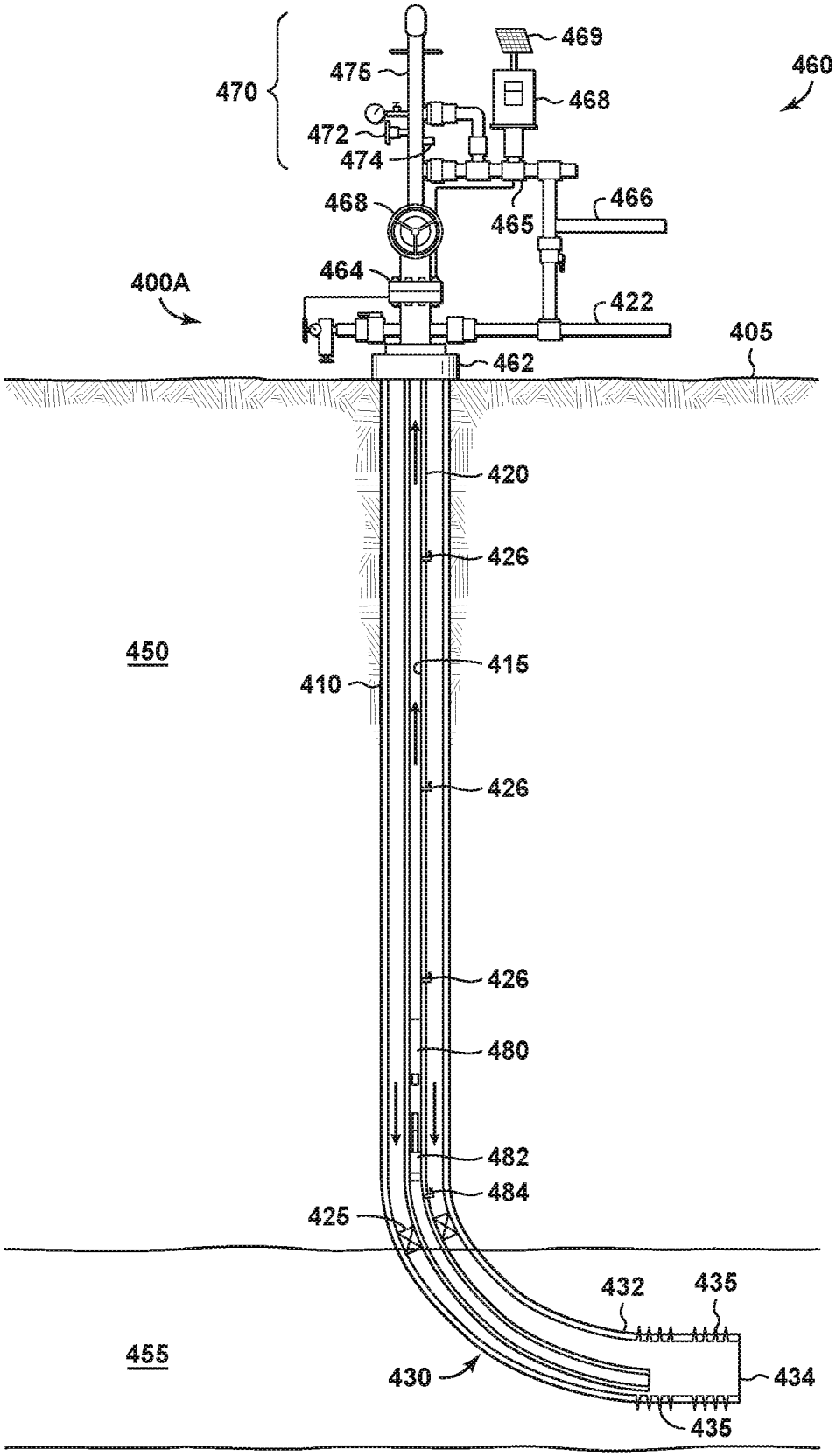
FIG. 4A is a side, partial cut-away view of a first wellbore having been completed for the production of hydrocarbon fluids. A plunger lift system has been installed. Of interest the well is completed to have a horizontal portion.

It is desirable to incorporate a plunger lift system into the wellbore, that is, a wellbore having one or more, or two or more, gas lift mandrels 100. FIG. 4A presents a side view of a wellbore 400A having been fitted with gas lift valves 426.

The illustrative wellbore 400A is completed horizontally, meaning that it includes a horizontal leg 430.

In FIG. 4A, the wellbore 400A extends from a surface 405 down into a subsurface 450. The wellbore 400A ultimately extends to a reservoir, or "pay zone," 455. The wellbore 400A is completed with at least one string of casing 410. While only one illustrative casing string 410 is shown, it is understood that the wellbore 400A will likely include multiple strings of casing, including a string of surface casing, one or more intermediate casing strings, and a string of production casing.

The string of production casing runs along the horizontal leg 430. The horizontal leg 430 will have a heel 432 and a toe 434. Perforations 435 are shown in the casing 410 proximate the toe 434. Those of ordinary skill in the art will understand that horizontally-completed wells may extend one, two, or even more miles, and will have multiple stages of perforations 435. In addition, the formation along the pay zone 455 is fractured through each of the sets of perforations 435 using various perf-and-frac techniques.

The wellbore 400A also includes a string of production tubing 420. The production tubing 420 defines a bore 415 through which reservoir fluids will travel to the surface 405. The gas lift valves 426 are placed in series along the production tubing 420. In addition, a packer 425 resides at a lower end of the vertical portion of the wellbore 400A. This ensures that gas injected into the annular region between the production tubing 420 and the surrounding casing 410 will enter the gas lift valves 426.

In a typical gas lift operation, light hydrocarbon gases are separated from the production fluids at the surface. A portion of the separated gases are then injected back into the annular region. In FIG. 4A, an injection line 422 is shown at the surface 405 for delivering the gases to the wellbore 400A.

Above the wellbore 400A is a well head 460. The well head 460 includes a casing head 462 and a tubing head 464. A sales line 466 is provided from the well head 460. A master valve 468 is placed above the tubing head 464 as a way of shutting in the wellbore 400A. An optional solar panel 469 is provided by local power.

Above the master valve 468 is a lubricator 470. The lubricator 470 defines an elongated and sealed cylindrical pipe 475. Along the pipe 475 is a plunger catcher 472 and an MSO sensor 474.

The plunger catcher 472 is designed to "catch" a metal cylinder, or "plunger" 480 when the plunger 480 is forced up to the surface 405. The plunger 480 moves up in response to a build-up of reservoir pressure, combined with the reduced hydrostatic head produced by the gas lift valves 426. The plunger 480 is then held at the plunger catcher 472 until such a time as it is released. The well head 460 includes a motor valve 465 and a controller 468 that assist in controlling the cycle for dropping the plunger 480.

When the plunger 480 is dropped from the lubricator 470, the plunger 480 will gravitationally fall P into the production tubing 420. The plunger 480 will ultimately land on a bumper spring 482. The bumper spring 482 sits on an optional screened orifice that permits injection gases to flow into the production tubing 420 from below the bumper spring 482, further assisting upward flow of the plunger 480.

Figure 4B:
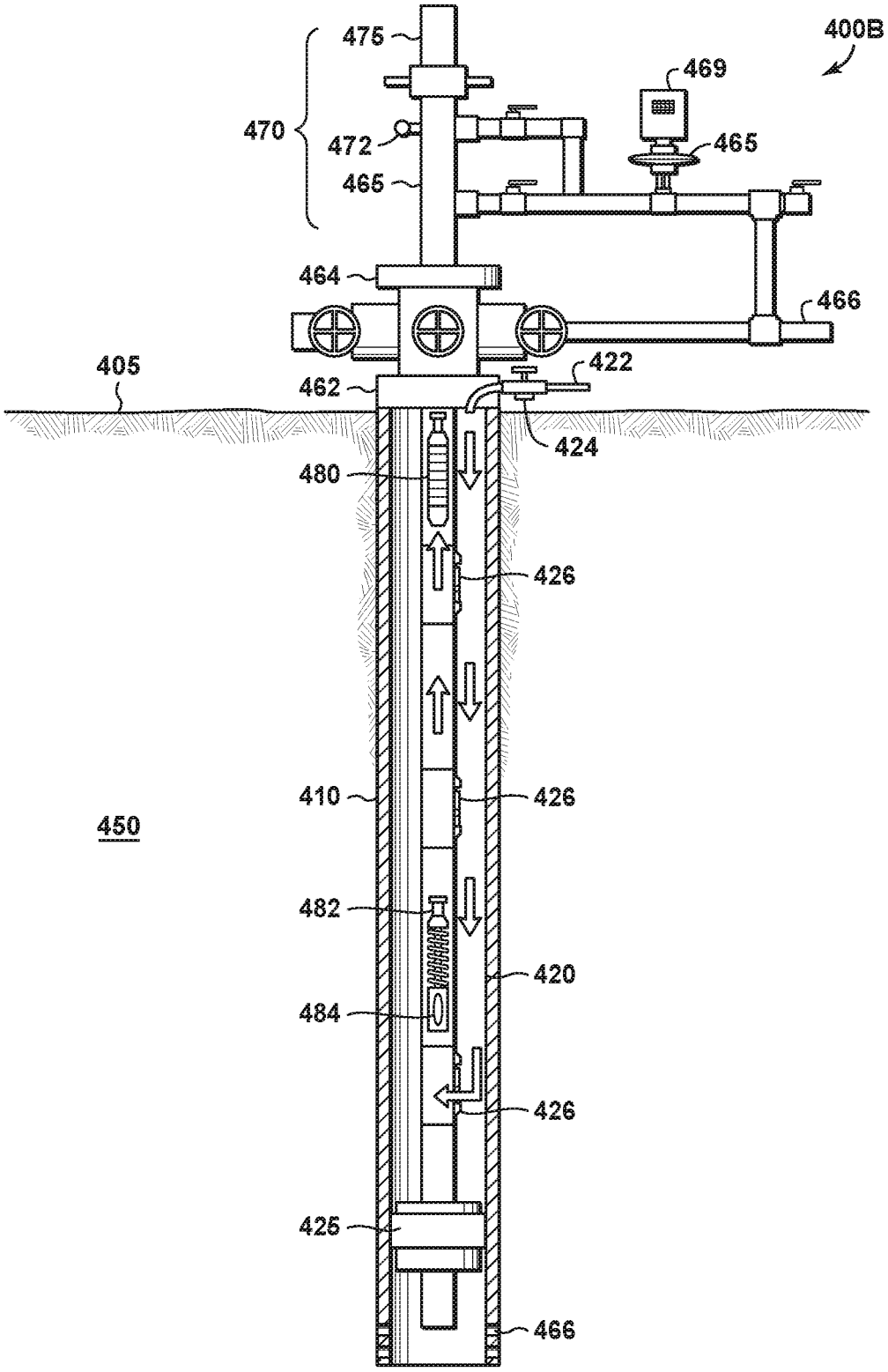
FIG. 4B is a side, partial cut-away view of a second wellbore having been completed for the production of hydrocarbon fluids. A plunger lift system has again been installed. Here, the well is completed vertically.

FIG. 4B is a side, partial cut-away view of a second wellbore 400B having been completed for the production of hydrocarbon fluids. The wellbore 400B is constructed in accordance with the wellbore 400A; however, the wellbore 400B has been completed vertically.

It is noted that the wellbore 400A is again completed to provide a gas-assisted plunger lift system. Here, in lieu of a screened orifice (484 in FIG. 4A), a gas lift valve 426 is provided below the bumper spring 482. Also, the well head 460 of FIG. 4B shows a valve 424 for controlling flow of injection gases from the injection line 422.

As noted above, known gas lift valves are not well-suited for use in conjunction with plunger lift systems. This is because the metal cylinder 480 tends to hang up on the pocket 130 of the side pocket mandrel 100. Therefore, the present disclosure provides various improved embodiments for an improved side pocket mandrel.

Figure 5A:
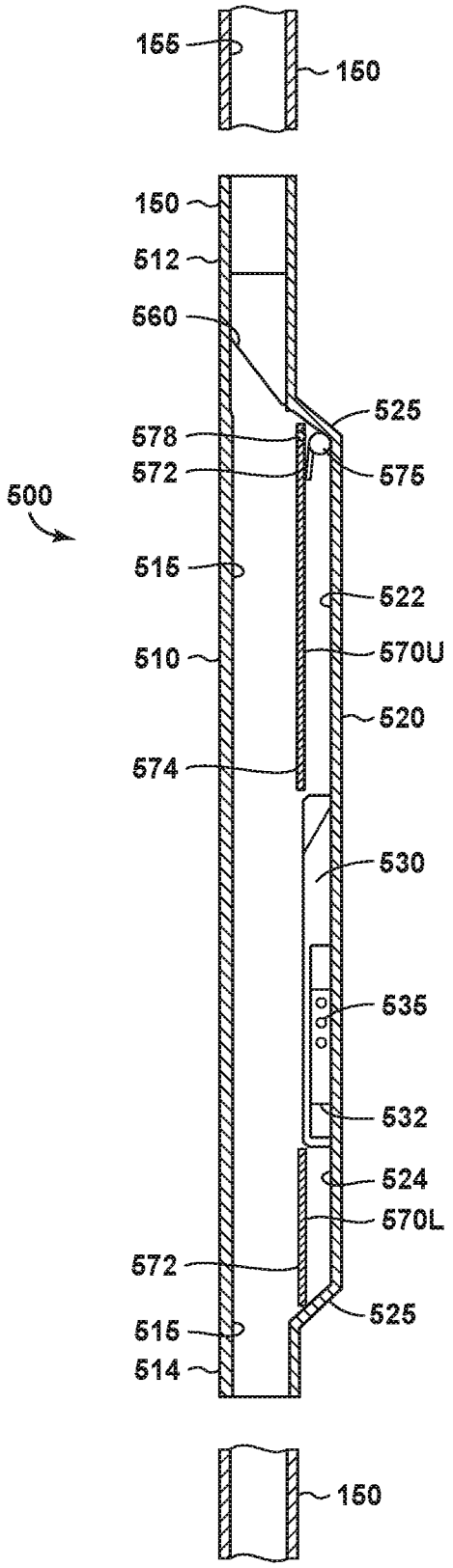
FIG. 5A is a schematic side view of a side pocket mandrel of the present invention, in one embodiment. This mandrel is intended to be threadedly connected to a string of production tubing within a wellbore. This embodiment employs a flexible metal curtain to movably cover an upper open portion of the side pocket mandrel.

FIG. 5A is a side view of a new side pocket mandrel 500 of the present invention, in one embodiment. As with mandrel 100 described above, the mandrel 500 is also intended to be threadedly connected to a string of production tubing 150, in series, within a wellbore. Beneficially, the mandrel 500 employs a flexible metal curtain 570U to movably cover an upper portion 522 of the side pocket mandrel 500.

The mandrel 500 is generally constructed in accordance with the mandrel 100 described above. In this respect, the side pocket mandrel 500 has a tubular body 510 comprising a wall that forms a bore 515. The bore 515 is in fluid communication with a bore 155 of the production tubing 150. The tubular body 510 also includes an upper end 512 and a lower end 514. The bore 515 extends from the lower end 514 up to the upper 512 end.

The side pocket mandrel 500 includes upper and lower shoulders 525. The shoulders 525 form an eccentric portion 520 of the body 510. The eccentric portion 520 forms an enlarged outer diameter portion. In this respect, the upper 512 and lower 514 ends have an inner diameter ($ID_1$) while the eccentric portion 520 has an increased inner diameter ($ID_2$).

The eccentric portion 520 holds an elongated barrel, or "pocket" 530. The pocket 530 is dimensioned to receive a gas lift valve 140. The pocket 530 includes one or more ports 535. The ports 535 are in fluid communication with an annulus formed between the production tubing 150 and a surrounding string of casing within the wellbore. In this way, gas that is injected behind the production tubing 150 may flow through the ports 535, into the pocket 530, and into the gas lift valve 140. From there, gas is controllably released into the bore 155 of the production tubing 150 as part of a gas lift operation.

The pocket 530 also includes one or more seating nipples 532. The seating nipples 532 are dimensioned to frictionally receive and hold the gas lift valve 140 within the pocket 530. In FIG. 5A, the pocket 530 is empty, meaning that it has not yet received a gas lift valve 140.

Also noted from FIG. 5A, there is an open portion 522 within the eccentric portion 520 above the pocket 530. Similarly, there is an open portion 524 below the pocket 530. These create areas of potential hang-up for the metal cylinder 480 moving through the production tubing 150 during a plunger lift operation.

To remedy this, a vertical curtain 570 is provided within the side pocket mandrel 500. The vertical curtain 570 includes an upper portion 570U and a lower portion 570L. The upper curtain 570U resides in or covers an open area 522 while the lower curtain 570L resides in or covers an open area 524. The upper curtain 570U is flexible, permitting access to the pocket 530 when the upper curtain 570U is moved, or flexed, from a closed position to an open position. In contrast, the lower curtain 570L is stationary, being fixed generally at upper and lower ends along the side pocket mandrel 500.

Both portions of the curtain 570U, 570L are preferably fabricated from a metal material. Preferably, each curtain 570U, 570L comprises a concave profile within the body 510.

The upper portion of the upper curtain 570U has an upper end 572 and a lower end 574. The upper end 572 is pivotally connected or otherwise pinned to the upper portion 512 of the mandrel 500 using a pin 578. The upper curtain 570U is biased in an outward position as shown in FIG. 5A using, for example, a spring 575. At the same time, the lower end 574 is free to travel in response to an inward force that overcomes the biasing force of the spring 575.

Figure 7A:
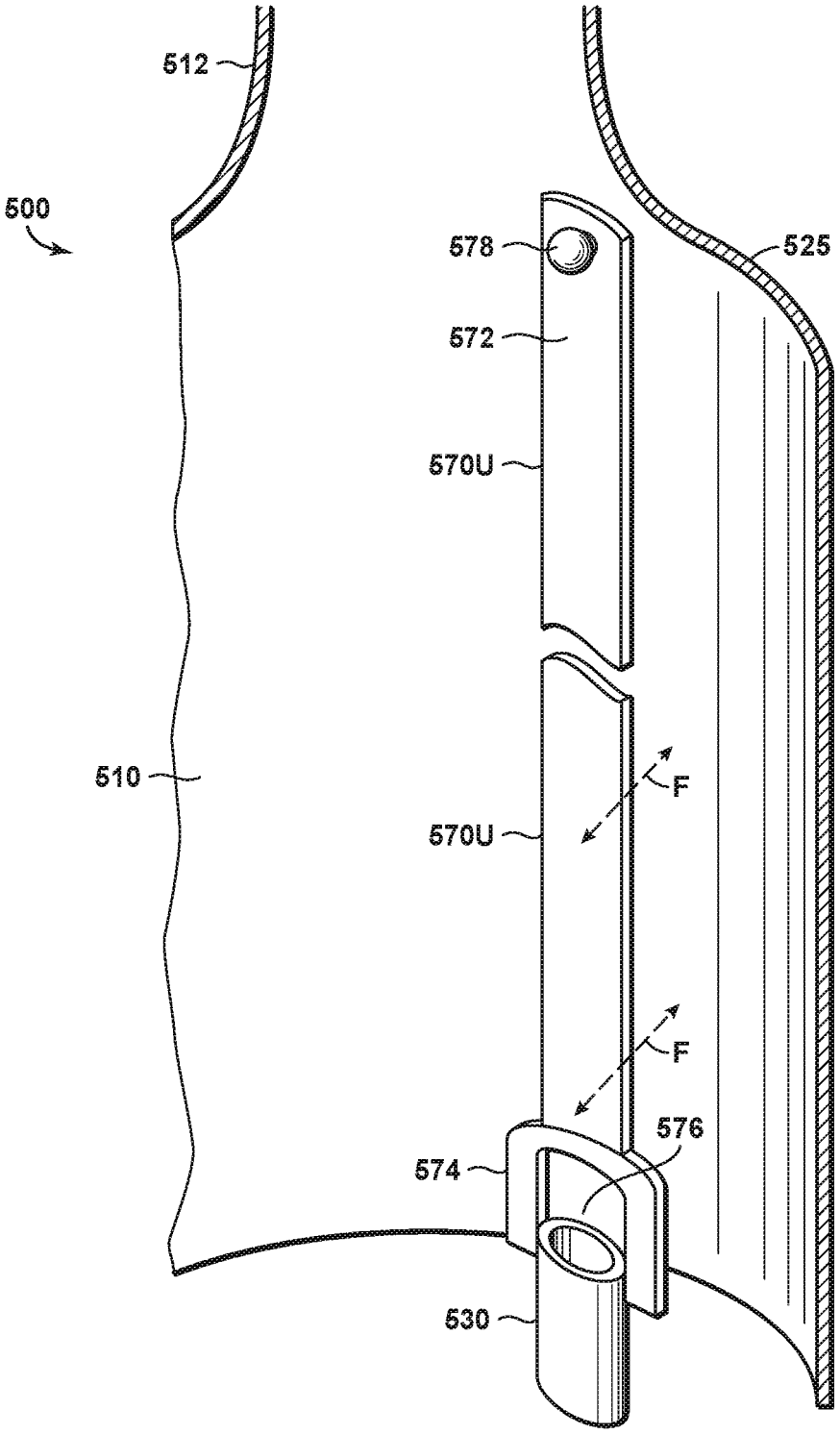
FIG. 7A is an enlarged perspective view of a bow spring. The bow spring may be used in lieu of the flexible metal curtain of the FIG. 5 series of drawings.

FIG. 7A is a perspective view of the upper curtain 570U, in one embodiment. It can be seen that the upper end 572 of the curtain 570U is pinned along or near the upper end 512 of the mandrel 500 using pin 578. The lower end 574 of the curtain 570U flexes back towards the tubular wall 510. Arrows F demonstrate a direction of movement in response to a lateral or inward force applied by a pivot arm 210 of a KOT 200.

It is noted that the lower end 574 of the curtain 570U straddles the pocket 530. To accommodate lateral movement of the lower end 574 during flexure of the curtain 570U, the lower end 574 reserves an opening 576 dimensioned to pass across the pocket 530.

Figure 5B:
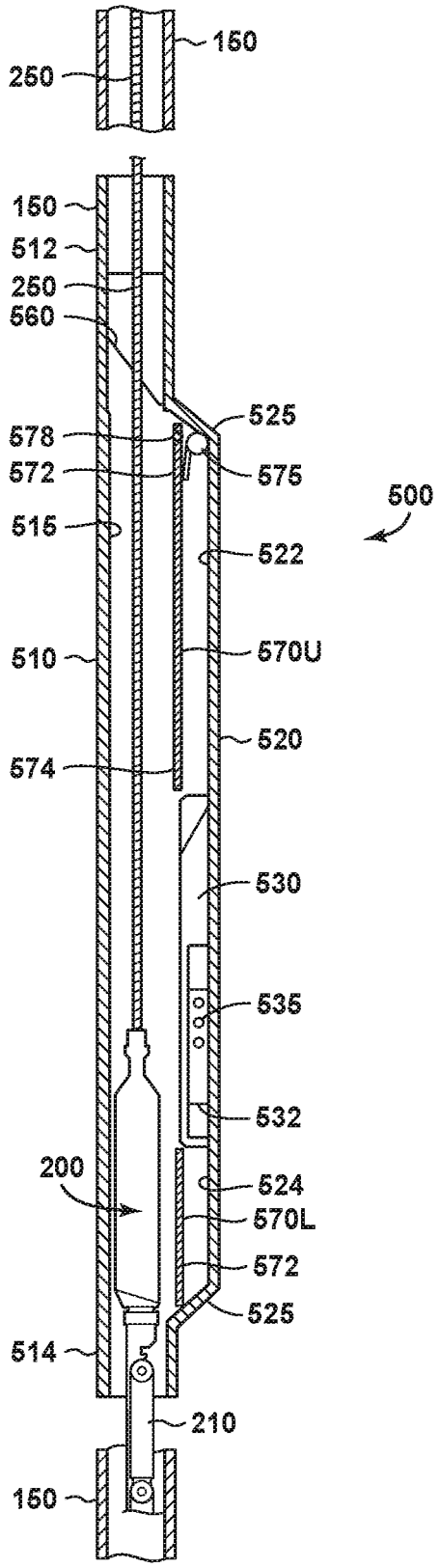
FIG. 5B is a side view of the side pocket mandrel of FIG. 5A. Here, a kick-over tool has been run into the production tubing and then partially past the side pocket mandrel. A wireline is again shown as a working string for the kick-over tool.

Returning to the FIG. 5 series of drawings, FIG. 5B is a side view of the side pocket mandrel 500 of FIG. 5A. Here, a kick-over tool 200 has been run into the production tubing 150 and then partially past the side pocket mandrel 500. A wireline 250 is again shown as a working string for the kick-over tool 200.

Figure 5C:
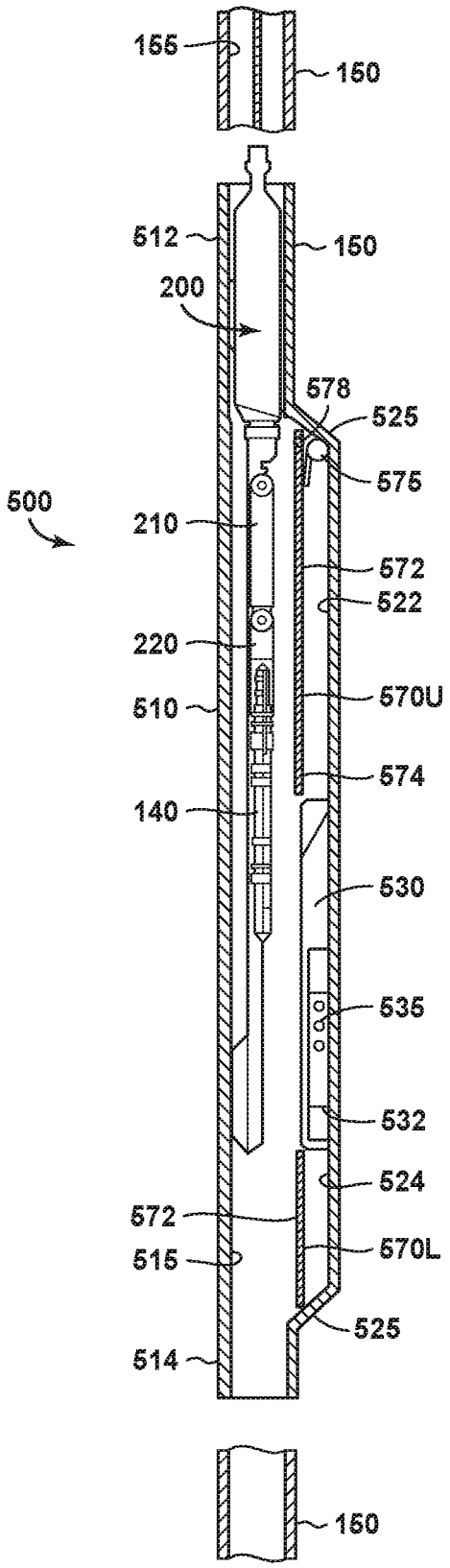
FIG. 5C shows another view of the side pocket mandrel of FIG. 5A. In this view, the kick-over tool has been raised up the wellbore. It can be seen that a gas lift valve is connected to a pivot arm of the kick-over tool.

FIG. 5C shows another view of the side pocket mandrel 500 of FIG. 5A. In this view, the kick-over tool 200 is being slowly raised up the wellbore alongside the mandrel 500. It can be seen that a gas lift valve 140 is connected to a pivot arm 210 of the kick-over tool 200.

As noted above in connection with FIG. 1C, the KOT 200 includes a guide key 205. The guide key 205 will make contact with an orienting sleeve 560 within the bore 115 of the tubular body 110.

Upon engaging a portion of the guide surface, the key 205 will follow the guide surface, causing the KOT 200 to rotate about its longitudinal axis until the guide key 205 becomes aligned with and enters an orienting slot. When the guide key 205 is in the orienting slot, the KOT 200 is properly oriented in the side pocket mandrel 100 with respect to the side pocket bore 120. Additionally, when the kick-over tool 200 stops, this indicates to the operator at the surface that the guide key 205 has contacted the slot at the top of the orienting sleeve 160.

Figure 5D:
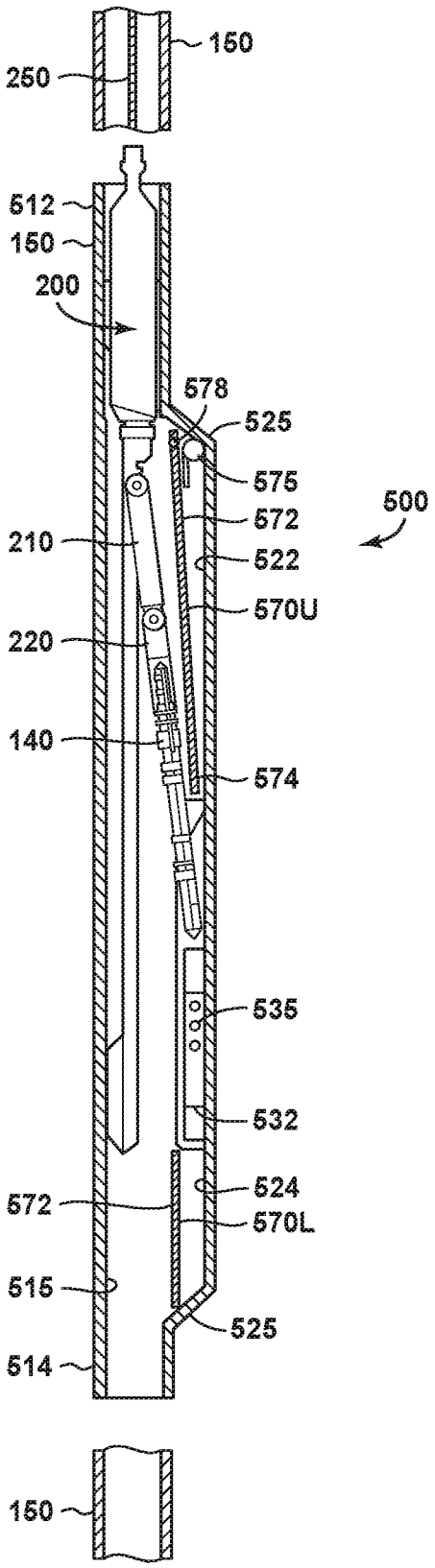
FIG. 5D is still another view of the side pocket mandrel of FIG. 5A. Here, the kick-over tool has been actuated. This is in response to a guide key catching on a slot within an orienting sleeve of the side pocket mandrel. Actuation of the pivot arm flexes the movable curtain, allowing the gas lift valve to access the pocket.

FIG. 5D is still another view of the side pocket mandrel 500 of FIG. 5A. Here, tension is being pulled on the wireline 250, causing the kick-over tool 200 to rotate into proper alignment. At the surface, tension is pulled until the weight indicator of the wireline unit indicates that enough weight is being applied to actuate the kick-over tool 200 to cause it to "kick out" into the bore of the eccentric portion 120. When this occurs, the gas lift valve 140 will be positioned over the pocket 130.

Figure 5E:
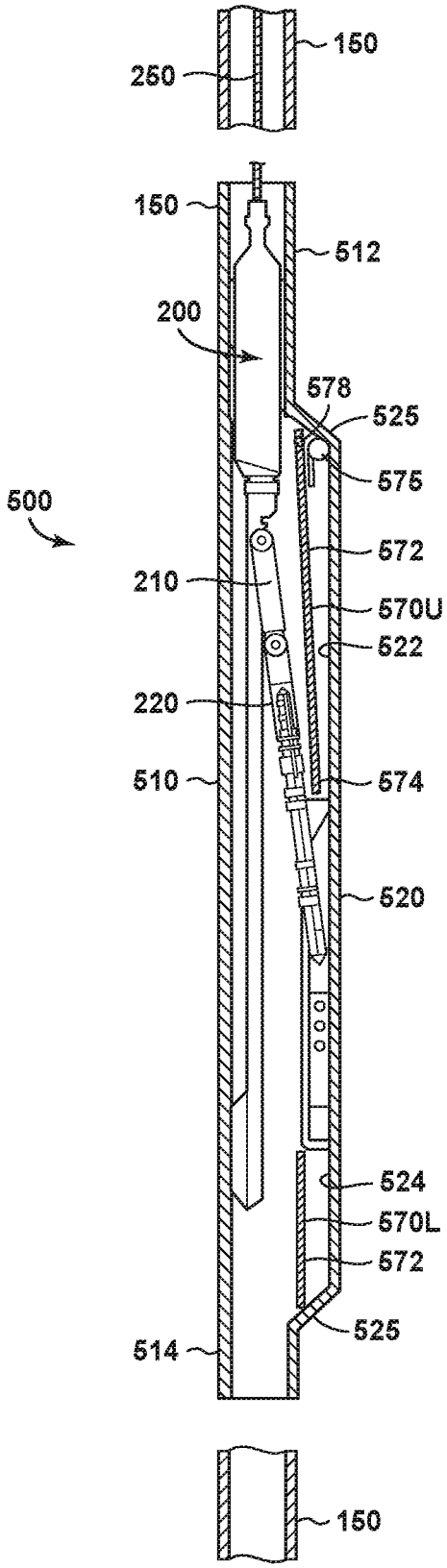
FIG. 5E is yet another side view of the side pocket mandrel of FIG. 5A.

FIG. 5E is yet another side view of the side pocket mandrel 500 of FIG. 5A. FIG. 5E shows a step where the gas lift valve 140 is lowered into the pocket (or "receiver") 130 of the side pocket mandrel 500. Notice that the pivot arm 210 keeps the flexible upper curtain 570U pushed back against the tubular wall 510 of the mandrel 500.

Figure 5F:
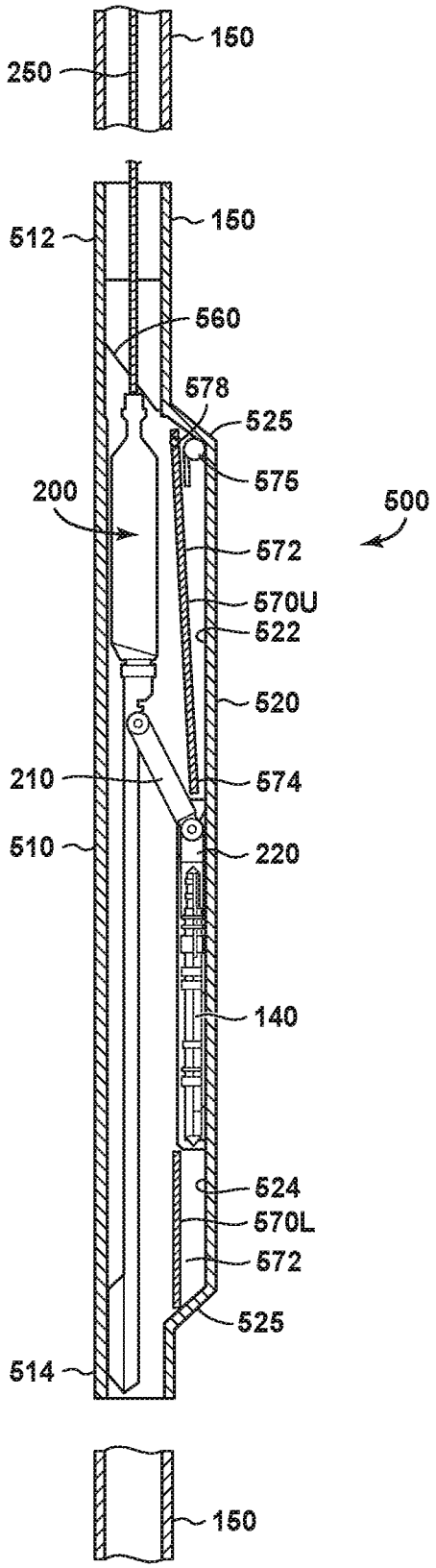
FIG. 5F provides another side view of the side pocket mandrel of FIG. 5A. In this step, the gas lift valve has been seated into the pocket of the side pocket mandrel. Notice that the pivot arm keeps the flexible metal curtain pushed back against the wall of the mandrel.

FIG. 5F provides another side view of the side pocket mandrel 500 of FIG. 5A. In this step, the gas lift valve 140 has been seated into the pocket 530. This is done by the operator quickly releasing tension on the wireline 250, reducing weight on the weight indicator to essentially "0." The gas lift valve 140 is seated in the seating nipples 532. Notice again that the pivot arm 210 keeps the flexible curtain 570U pushed back against the tubular wall 510 of the mandrel 500.

Figure 5G:
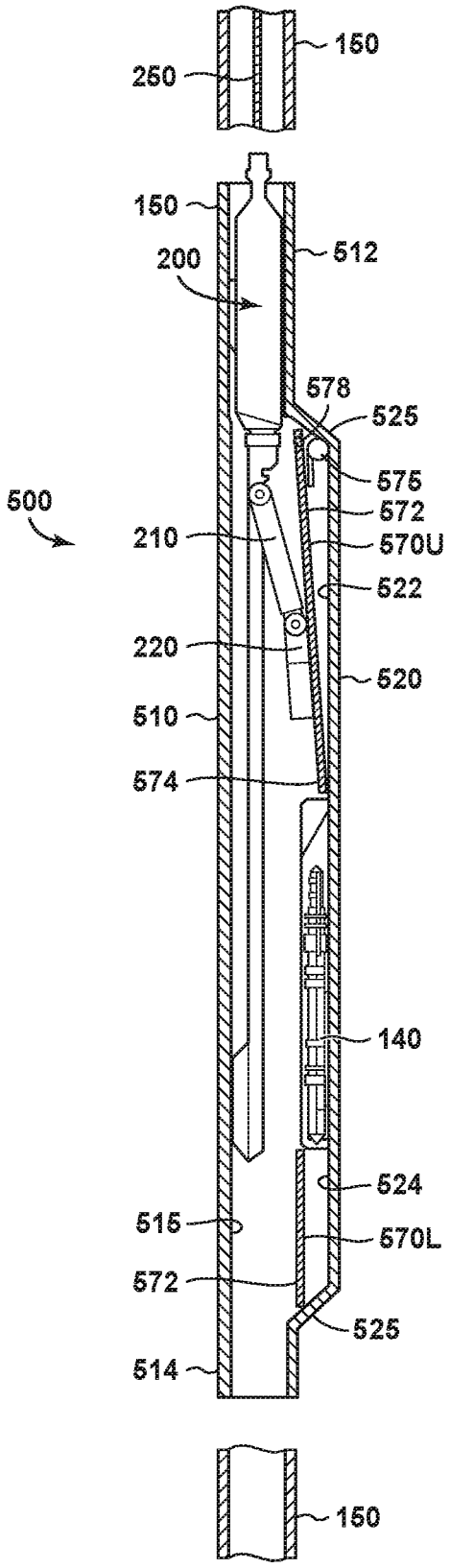
FIG. 5G is still another side view of the side pocket mandrel of FIG. 5A. Here, the pivot arm assembly has released the frictional connection with the gas lift valve.

FIG. 5G is still another side view of the side pocket mandrel 500 of FIG. 5A. In this view, the kick-over tool 200 is raised. The guide key 205 associated with the kick-over tool 200 catches in the orienting sleeve 160, allowing the wireline 250 and connected kick-over tool 200 to "hang up" in the wellbore. The operator then jars upward on the kick-over tool 200. This is done by rapidly applying tension to the wireline 250, up to a designated weight. This will cause a frictional run-in connection to become disconnected, releasing the KOT 200 from the gas lift valve 140.

In operation, as the KOT 200 is raised, it will hit the upper shoulder 525 of the eccentric portion 520. This will fold the pivot arm 210 back into its run-in position.

Figure 5H:
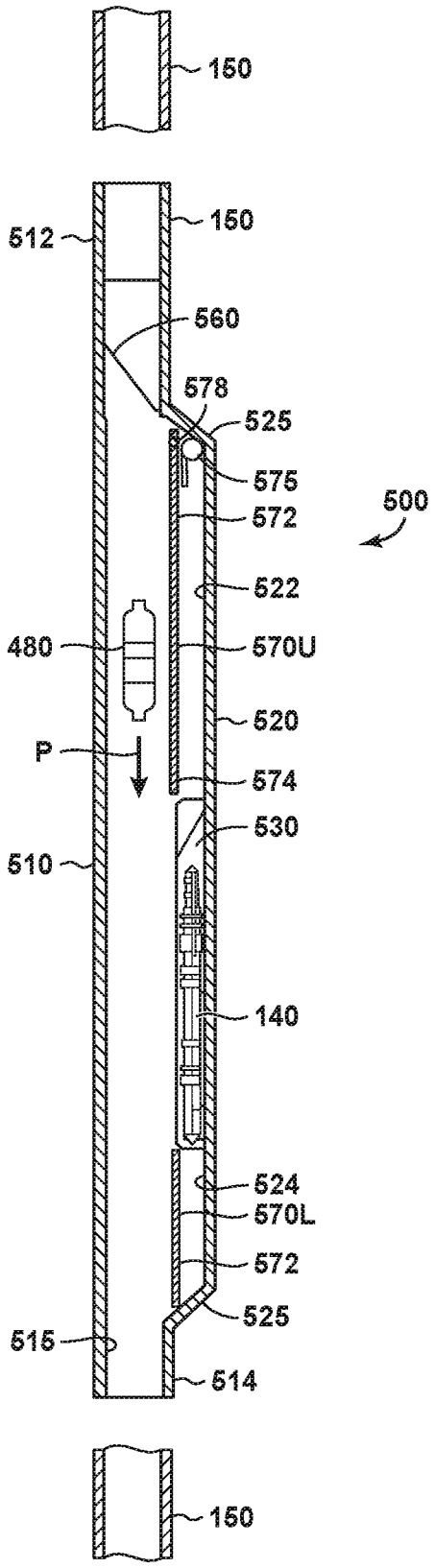
FIG. 5H is a final side view of the side pocket mandrel of FIG. 5A. The view of FIG. 5H is the same as FIG. 5A, except the gas lift valve now resides in the pocket of the side pocket mandrel, ready for use in a gas lift operation. The curtain has returned to its operational position.

FIG. 5H is a final side view of the side pocket mandrel 500 of FIG. 5A. The view of FIG. 5H is the same as FIG. 5A, except the gas lift valve 140 now resides in the pocket 530 of the side pocket mandrel 500, ready for use in a gas lift operation.

Figure 7B:
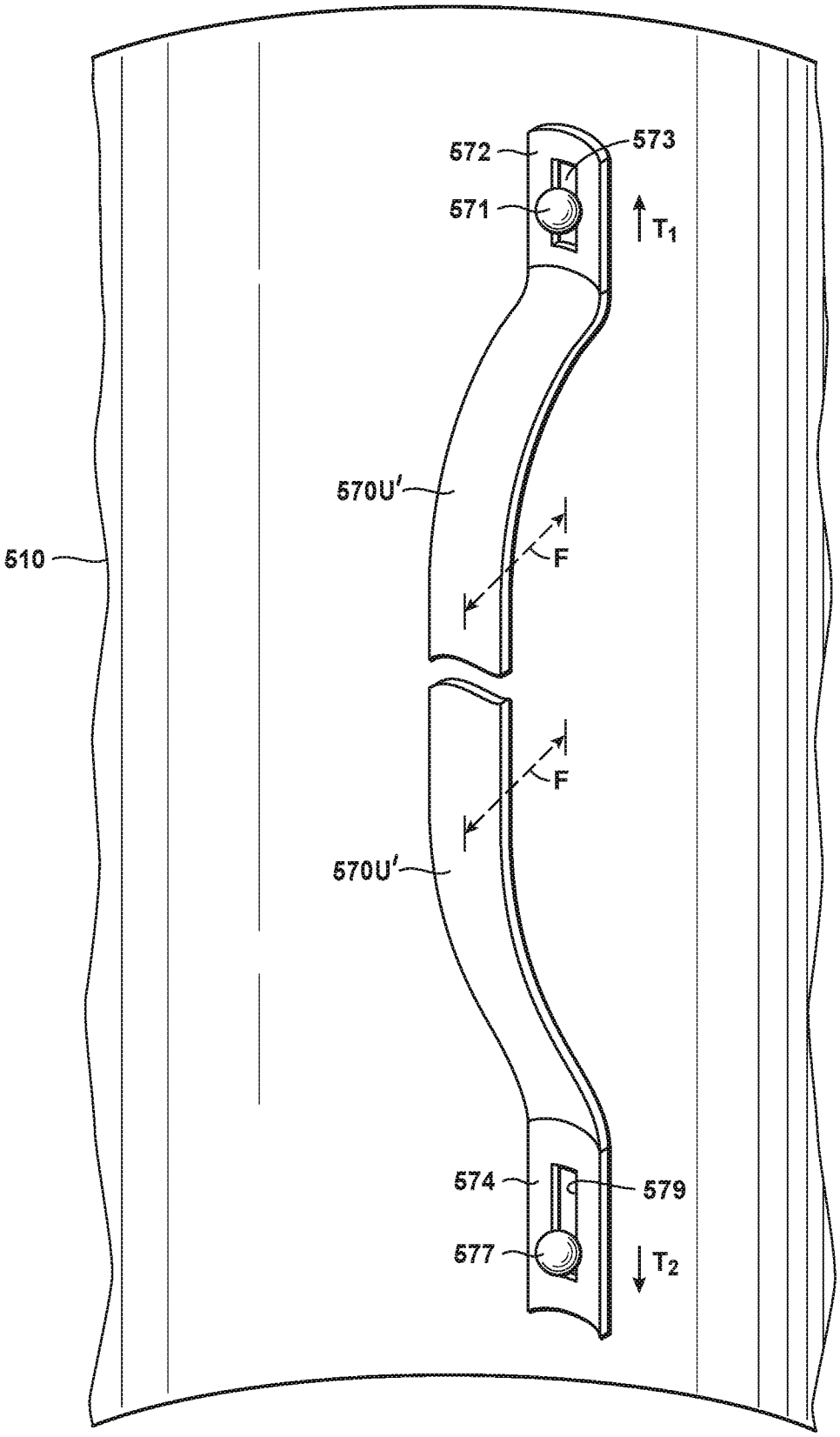
FIG. 7B is an enlarged perspective view of the flexible metal curtain of the FIG. 5 series of drawings.

An alternate embodiment may be employed for the upper curtain. FIG. 7B is an enlarged perspective view of the flexible metal curtain 570U' of the FIG. 5 series of drawings, in an alternate embodiment. Here, the upper metal curtain 570U' is in the form of a bow spring. The upper end 572 of the bow spring 570U' is connected to the tubular wall 510 be means of pin 571, while the lower end 574 of the curtain 570U' is connected to the tubular wall 510 by means of pin 577.

Pin 571 resides within slot 573, while pin 577 resides in slot 579. Each pin 571, 577 is configured to slide relative to its respective slot 573, 579. In operation, a lateral force is applied by the pivot arm 210 against the bow spring 570U'. This causes the bow spring 570U' to flex inwardly according to Arrow F.

To accommodate the inward movement, the upper end 572 of the bow spring 570U' will slide upward per Arrow $T_1$, guided by pin 571. Similarly, the lower end 574 of the bow spring 570U' will slide downward per Arrow $T_2$, guided by pin 577. Note that slot 579 is preferably much longer than slot 573, permitting the bow spring 570U' to flatten out more easily along the bottom end 574.

Figure 6A:
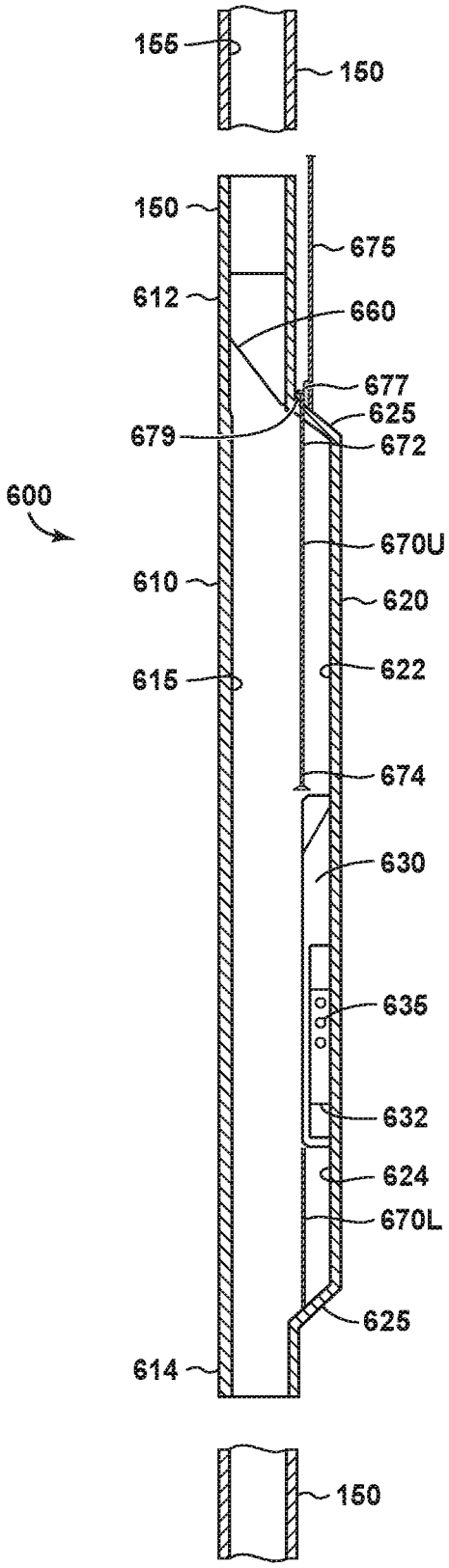
FIG. 6A is a schematic side view of a side pocket mandrel of the present invention, in a second illustrative embodiment. This mandrel is also intended to be threadedly connected to a string of production tubing within a wellbore. This embodiment employs a sliding metal curtain that moves vertically to cover and uncover an upper open portion of the side pocket mandrel.

FIG. 6A is a schematic side view of a side pocket mandrel 600 of the present invention, in a second illustrative embodiment. As with mandrel 100 described above, the mandrel 600 is also intended to be threadedly connected to a string of production tubing, in series, within a wellbore. Beneficially, the mandrel 600 employs a sliding metal curtain that moves vertically to cover and uncover an upper open portion 622 of the side pocket mandrel 600.

The mandrel 600 is generally constructed in accordance with the mandrel 100 described above. In this respect, the side pocket mandrel 600 has a tubular body 610 comprising a wall that forms a bore 615. The bore 615 is in fluid communication with a bore 155 of the production tubing 150. The tubular body 610 also includes an upper end 612 and a lower end 614. The bore 615 extends from the lower end 614 up to the upper 612 end.

The side pocket mandrel 600 includes upper and lower shoulders 625. The shoulders 625 form an eccentric portion 620 of the body 610. The eccentric portion 620 forms an enlarged outer diameter portion. In this respect, the upper 612 and lower 614 ends have an inner diameter ($ID_1$) while the eccentric portion 620 has an inner diameter ($ID_2$).

The eccentric portion 620 holds an elongated barrel, or "pocket" 630. The pocket 630 is dimensioned to receive a gas lift valve 140. The pocket 630 includes one or more ports 635. The ports 635 are in fluid communication with an annulus formed between the production tubing 150 and a surrounding string of casing (shown at 410 of FIG. 4A) within the wellbore.

The pocket 630 also includes one or more seating nipples 632. The seating nipples 632 are dimensioned to frictionally receive and hold the gas lift valve 140 within the pocket 630. In FIG. 6A, the pocket 630 is empty, meaning that it has not yet received a gas lift valve 140.

Also noted from FIG. 6A, there is an open portion 622 within the eccentric portion 620 above the pocket 630. Similarly, there is an open portion 624 below the pocket 630. These create areas of potential hang-up for the metal cylinder 480 moving P through the production tubing 150 during a plunger lift operation.

To remedy this, a vertical curtain 670 (represented in two parts at 670U and 670L) is provided within the side pocket mandrel 600. An upper curtain 670U resides in the open area 622 while a lower curtain 670L resides in the open area 624. The upper curtain 670U is slidably movable vertically, permitting access to the pocket 630 when the upper curtain 670U is raised from a closed position to an open position. In contrast, the lower curtain 670L is stationary, being fixed at upper and lower ends along the side pocket mandrel 600. Both portions of the curtain 670U, 670L are preferably fabricated from a metal material.

The upper portion of the upper curtain 670U has an upper end 672 and a lower end 674. The upper end 672 is in the form of a shoulder that lands on the upper shoulder 625 of the tubular body 610. At the same time, the lower end 674 comprises a travel stop, limiting the upward mobility of the upper curtain 670U when it is raised.

Figure 8:
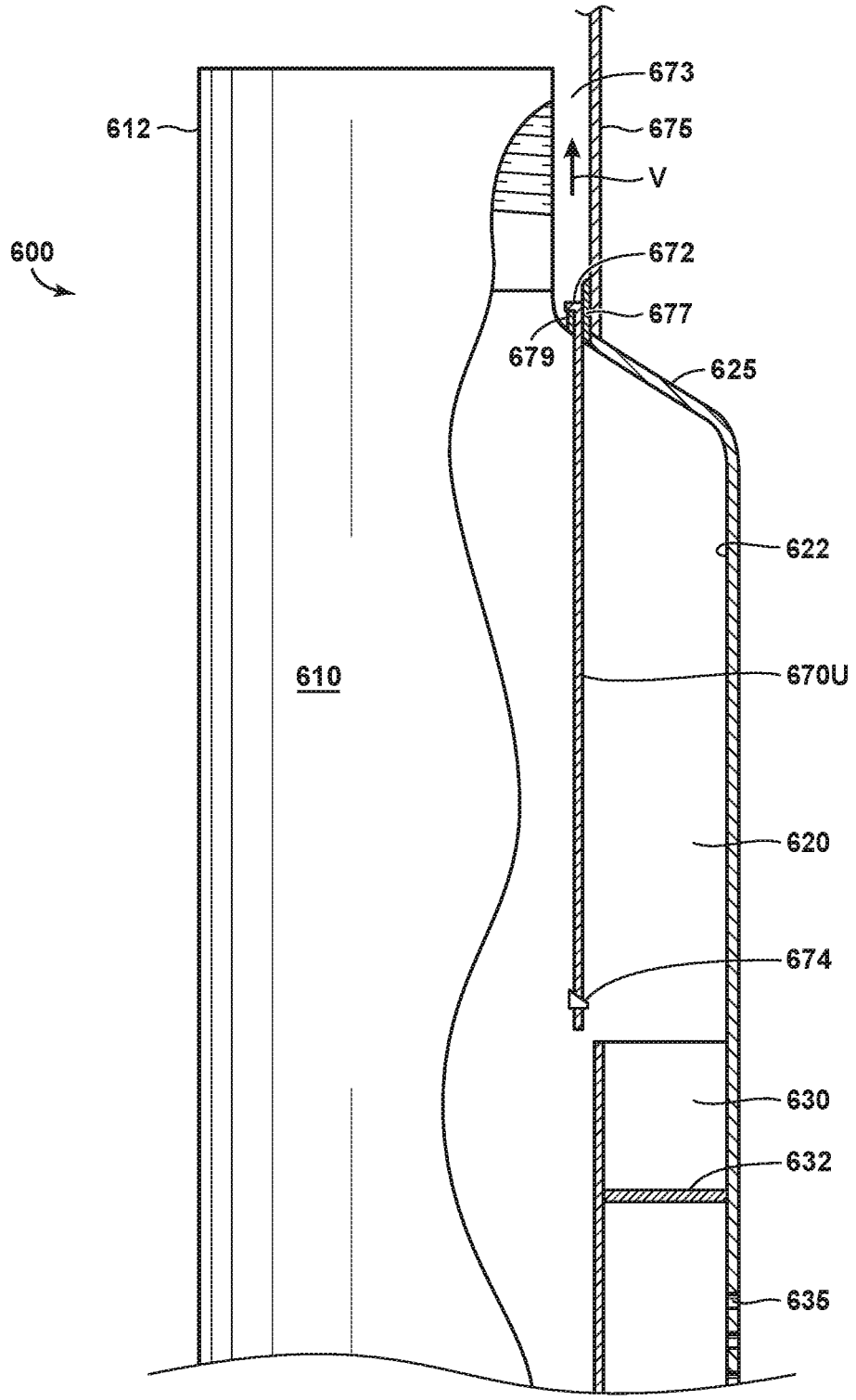
FIG. 8 is an enlarged cross-sectional view of the sliding metal curtain of the FIG. 6 series of drawings.

FIG. 8 is a cut-away view of the upper curtain 670U, in one embodiment. It can be seen that the upper curtain 670U is in its lowered position, covering the upper portion 622 of the eccentric portion 620. The upper curtain 670U is configured to slide vertically through a slot 679 residing within the shoulder 625. Arrow V indicates a direction of movement of the upper curtain 670U in response to upward force supplied by the pivot member 210 during upward translation across the side pocket mandrel 600.

As the curtain 670U slides upward, it enters a sleeve 673. The sleeve 673 is formed between the upper portion 612 of the mandrel 600 and a vertical guide wall 675. The vertical guide wall 675 extends upward from the shoulder 625 of the tubular body 610. Preferably, an elastomeric gasket 677 creates a seal around the sliding curtain 670.

Figure 6B:
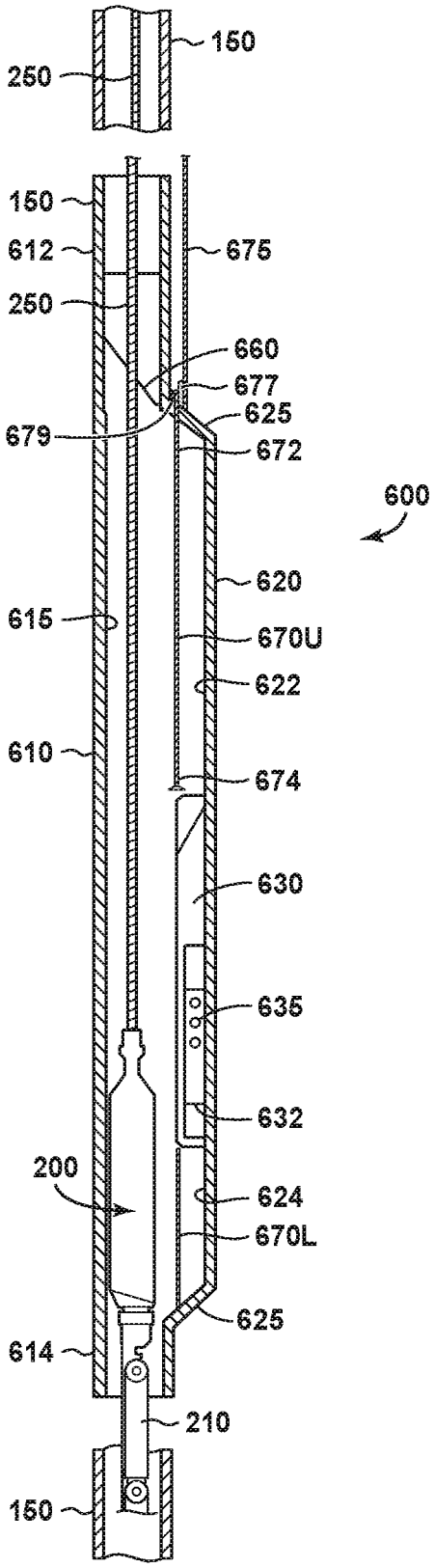
FIG. 6B is a side view of the side pocket mandrel of FIG. 6A. Here, a kick-over tool has been run into the production tubing and then partially past the side pocket mandrel. A wireline is again shown as a working string for the kick-over tool.

Returning to the FIG. 6 series of drawings, FIG. 6B is a side view of the side pocket mandrel 600 of FIG. 6A. Here, a kick-over tool 200 has been run into the production tubing 150 and then partially past the side pocket mandrel 600. A wireline 250 is again shown as a working string for the kick-over tool 200. The upper curtain 670U remains in its lowered position.

Figure 6C:
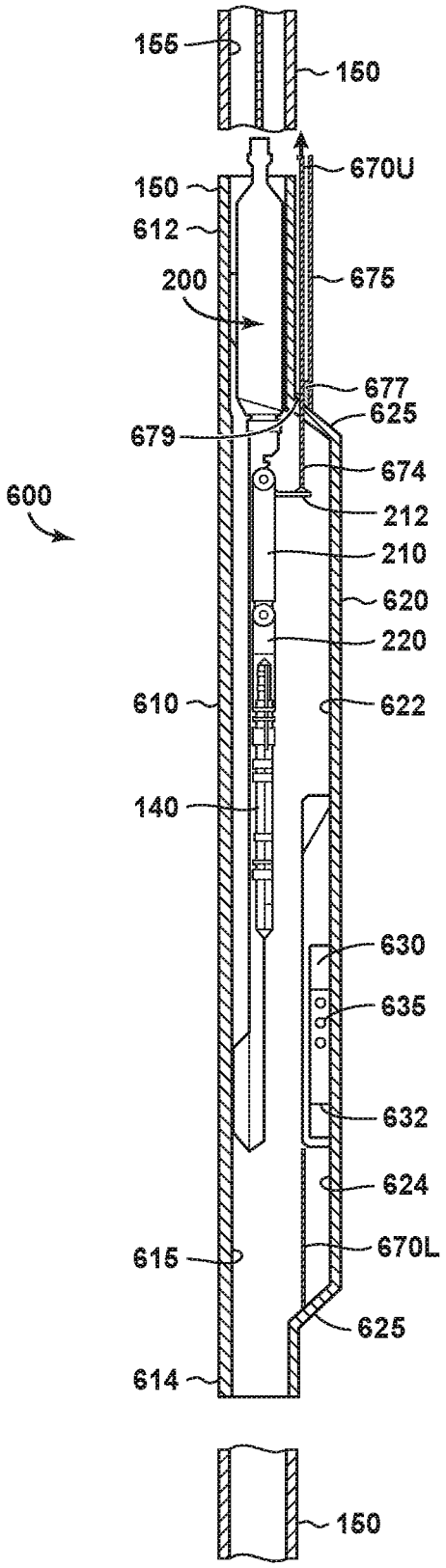
FIG. 6C shows another view of the side pocket mandrel of FIG. 6A. In this view, the kick-over tool has been raised up the wellbore. It can be seen that a gas lift valve is connected to a pivot arm of the kick-over tool. It can also be seen that raising of the kick-over tool causes the sliding metal curtain to be raised.

FIG. 6C shows another view of the side pocket mandrel 600 of FIG. 6A. In this view, the kick-over tool 200 is being slowly raised up the wellbore alongside the mandrel 600. It can be seen that a gas lift valve 140 is connected to a pivot arm 210 of the kick-over tool 200.

As noted above in connection with FIG. 1C, the KOT 200 includes a guide key 205. The guide key 205 will make contact with an orienting sleeve 660 within the bore 115 of the tubular body 110. Upon engaging one of the guide surfaces, the key 205 will follow the guide surface, causing the KOT 200 to rotate about its longitudinal axis until the guide key 205 becomes aligned with and enters the orienting slot. When the guide key 205 is in the orienting slot, the KOT 200 is properly oriented in the side pocket mandrel 100 with respect to the side pocket bore 120. Additionally, when the kick-over tool 200 stops, this indicates to the operator at the surface that the guide key 205 has contacted the slot at the top of the orienting sleeve 160.

It is also observed from FIG. 6C that the upper curtain 670U has been raised into the sleeve 673. This is done by a knob 212 placed along the KOT, such as at an upper end of the pivot arm 210, catching the lower end 674 of the curtain 670U. Thus, as the KOT 200 is raised, the curtain 670U is raised with it.

Figure 6D:
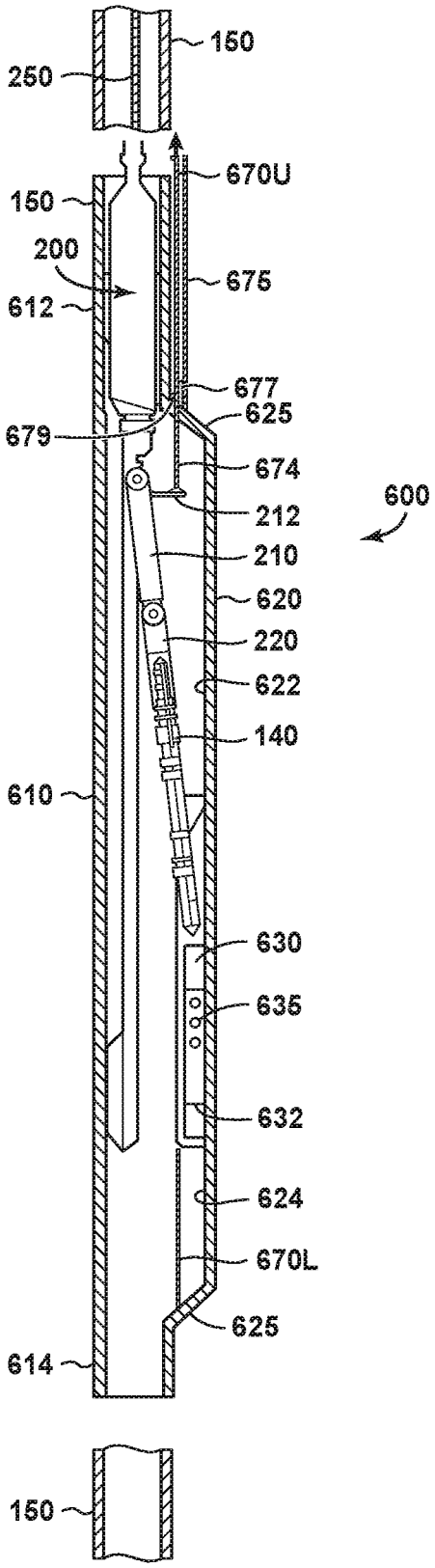
FIG. 6D is still another view of the side pocket mandrel of FIG. 6A. Here, the kick-over tool has been actuated. This is in response to a guide key catching on a slot within an orienting sleeve of the side pocket mandrel.

FIG. 6D is still another view of the side pocket mandrel 600 of FIG. 6A. Here, tension is being pulled on the wireline 250, causing the kick-over tool 200 to rotate into proper alignment. At the surface, tension is pulled until the weight indicator of the wireline unit indicates that enough weight is being applied to actuate the kick-over tool 200 to cause it to "kick out" into the bore of the eccentric portion 120. When this occurs, the gas lift valve 140 will be positioned over the pocket 130.

Figure 6E:
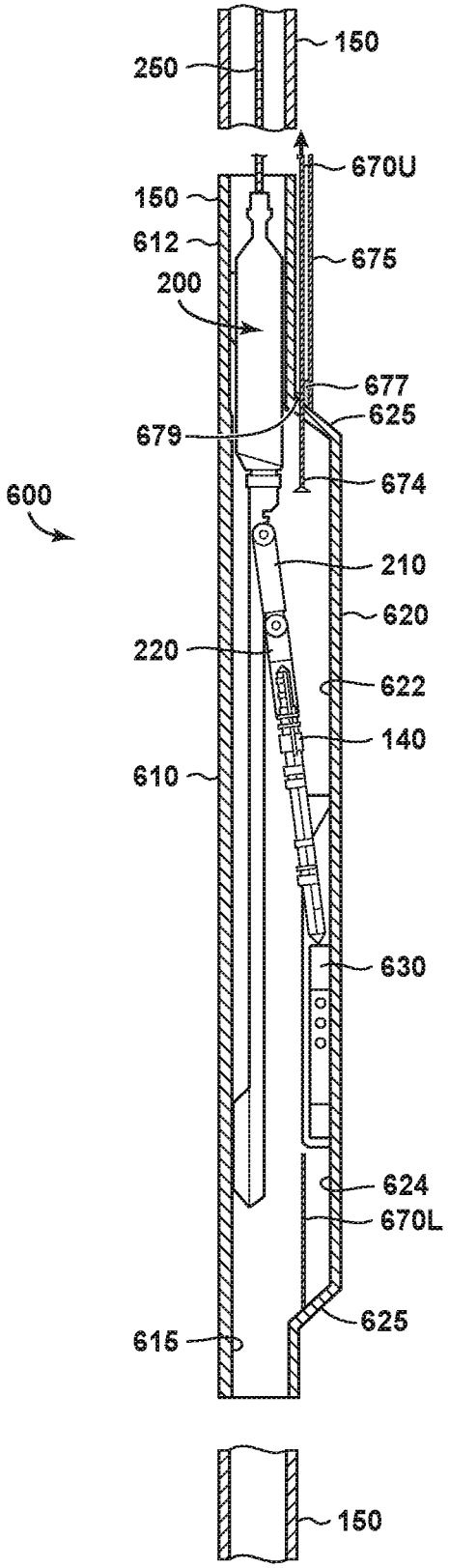
FIG. 6E is yet another side view of the side pocket mandrel of FIG. 6A.

FIG. 6E is yet another side view of the side pocket mandrel 600 of FIG. 6A. FIG. 6E shows a step where the gas lift valve 140 is lowered into the pocket (or "receiver") 630 of the side pocket mandrel 600. As long as the knob 212 is present below the shoulder forming the lower end 674 of the curtain 670U, the upper curtain 670U will remain in its raised position.

Figure 6F:
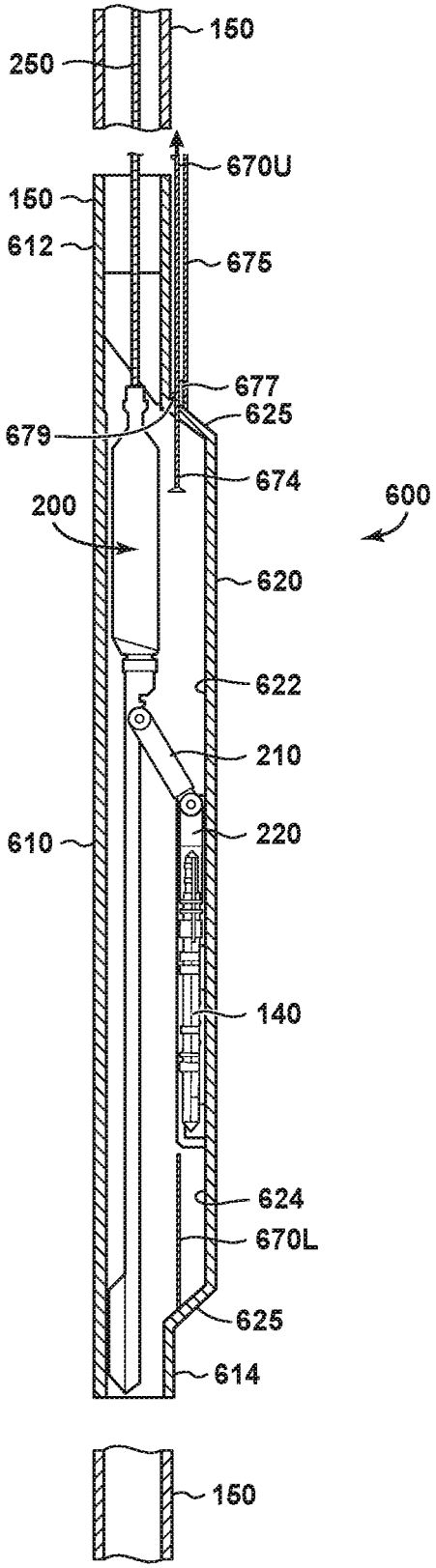
FIG. 6F provides another side view of the side pocket mandrel of FIG. 6A. In this step, the gas lift valve has been seated into the pocket of the side pocket mandrel while the sliding metal curtain remains raised.

FIG. 6F provides another side view of the side pocket mandrel 600 of FIG. 6A. In this step, the gas lift valve 140 has been seated into the pocket 630. This is done by the operator quickly releasing tension on the wireline 250, reducing weight on the weight indicator to essentially "0." The gas lift valve 140 is seated in the seating nipples 632. Notice again that the KOT 200 keeps the sliding metal curtain 670U from gravitationally falling all the way back down into the eccentric portion 620.

In one aspect, the sliding metal curtain 670U will ride on the knob 212 as the KOT 200 is lowered. Once a valve 140 is set or pulled and the KOT 200 is raised back up, it will temporarily lift the curtain 670U again until the KOT 200 is pulled out of the mandrel 600. The curtain 670U will then gravitationally fall back into place across the upper open (or eccentric) portion 620.

Figure 6G:
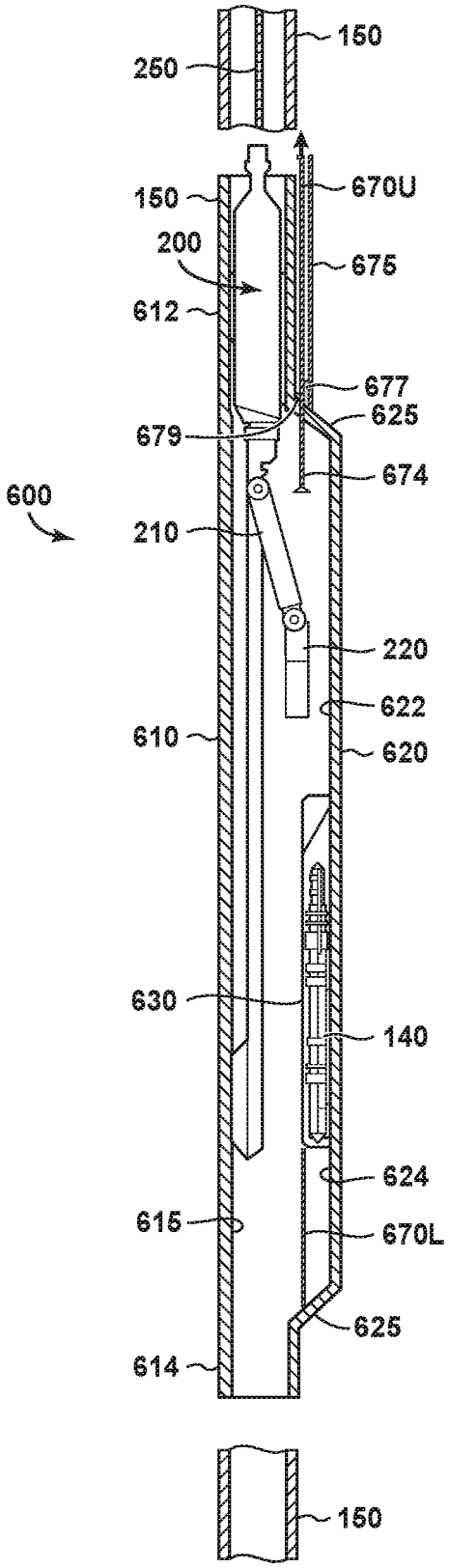
FIG. 6G is still another side view of the side pocket mandrel of FIG. 6A. Here, the pivot arm assembly has released the frictional connection with the gas lift valve.

FIG. 6G is still another side view of the side pocket mandrel 600 of FIG. 6A. In this view, the kick-over tool 200 is raised. The guide key 205 associated with the kick-over tool 200 catches in the orienting sleeve 160, allowing the wireline 250 and connected kick-over tool 200 to "hang up" in the wellbore. The operator then jars upward on the kick-over tool 200. This is done by rapidly applying tension to the wireline 250, up to a designated weight. This will cause a frictional run-in connection to become disconnected, releasing the KOT 200 from the gas lift valve 140.

In operation, as the KOT 200 is raised, it will hit the upper shoulder 625 of the eccentric portion 620. This will fold the pivot arm 210 back into its run-in position.

Figure 6H:
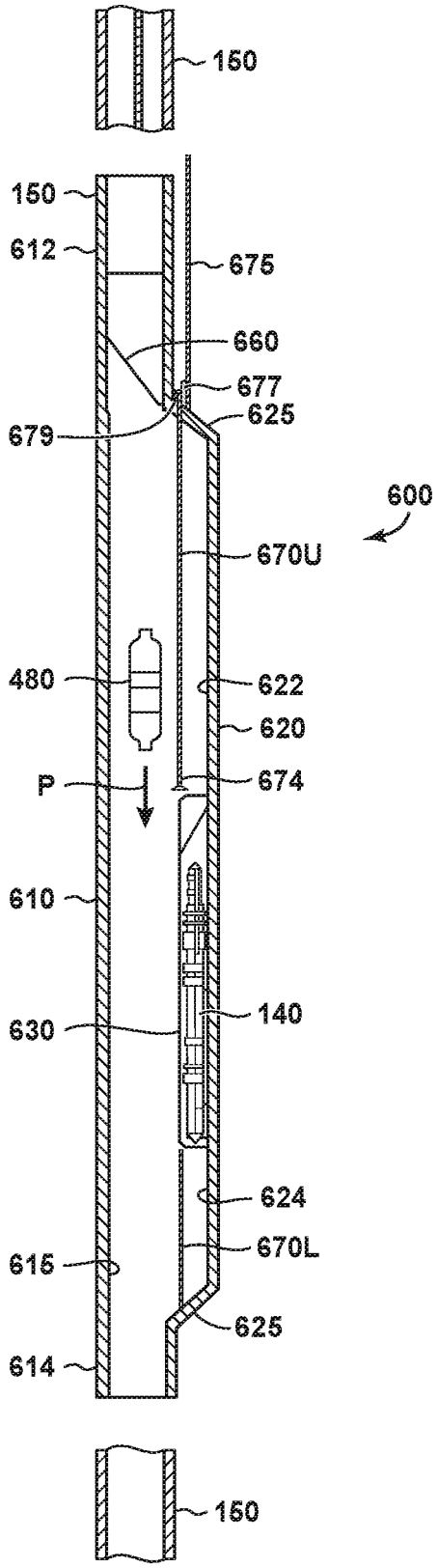
FIG. 6H is a final side view of the side pocket mandrel of FIG. 6A. The view of FIG. 6H is the same as FIG. 6A, except the gas lift valve now resides in the pocket of the side pocket mandrel, ready for use in a gas lift operation. Notice that a metal cylinder is again passing P across the side pocket mandrel in connection with a plunger lift operation.

FIG. 6H is a final side view of the side pocket mandrel 600 of FIG. 6A. The view of FIG. 6H is the same as FIG. 6A, except the gas lift valve 140 now resides in the pocket 630 of the side pocket mandrel 600, ready for use in a gas lift operation. Notice that a metal cylinder 480 is again passing across the side pocket mandrel in connection with a plunger lift operation.

A method of producing hydrocarbon fluids from a wellbore is also provided herein. The wellbore comprises a wellhead at a surface, and at least one string of casing extending down from the wellhead. The wellbore has been formed for the purpose of producing hydrocarbon fluids to the surface in commercially viable quantities. Typically, the well will produce primarily hydrocarbon fluids that are compressible at surface conditions, e.g., methane and ethane, but there will likely also be at least some hydrocarbon liquids, albeit in diminishing quantities.

The method first comprises running a string of production tubing into the wellbore. The string of production tubing comprises a series of tubing joints threadedly connected end-to-end. The production tubing will also include at least one, and preferably two or more side pocket mandrels threadedly connected along the production tubing.

The side pocket mandrels are configured in accordance with any of the embodiments described above. Of importance, the pocket of each side pocket mandrel will contain a gas lift valve that is in fluid communication with the annulus formed between the production tubing and the surrounding casing.

The method also includes producing hydrocarbon fluids from a subsurface reservoir, through the production tubing, and up to the wellhead at the surface.

Preferably, in its ($P_1$) position, the movable curtain is dimensioned and configured to allow a metal cylinder used as part of a plunger lift system to pass along the side pocket mandrel without catching on the pocket. The method then further comprises:

releasing the metal cylinder from a lubricator disposed over the wellhead into the wellbore; and allowing the metal cylinder to gravitationally fall to a bumper spring positioned along the production tubing below the side pocket mandrels.

The movable curtain comprises an elongated metal wall positioned above the receiver. The curtain flexes in response to a lateral force, moving the curtain from a first position ($ID_1$) having a first inner diameter to a second position ($ID_2$) having a second larger diameter.

As can be seen, an improved artificial lift system for a wellbore is provided. In accordance with the invention, gas lift valves are provided that will accommodate the cyclical vertical travel of a metal cylinder during a plunger lift operation.

Further variations of the gas lift valve and of the artificial lift systems herein may fall within the spirit of the claims, below. It will be appreciated that the inventions are susceptible to modification, variation and change without departing from the spirit thereof

What is claimed is:

1. A side pocket mandrel for a wellbore, comprising:

a tubular body having an upper end, an opposing lower end, and a bore formed within the tubular body extending from the upper to the lower end, and wherein the tubular body comprises an eccentric portion residing between the upper and lower ends such that a first inner diameter ($ID_1$) is formed at the opposing upper and lower ends, and a second larger inner diameter ($ID_2$) is formed along the eccentric portion;

a tubular pocket residing within the eccentric portion of the tubular body, the tubular pocket being dimensioned to slidably receive a gas lift valve;

one or more ports disposed within the tubular body adjacent the pocket, placing the pocket in fluid communication with an environment external to the tubular body; and a movable curtain disposed along the eccentric portion, wherein in a first position ($P_1$) the movable curtain covers a portion of the eccentric portion above the pocket to provide a reduced inner diameter that approximates ($ID_1$), and in a second position ($P_2$) the movable curtain is movable to a larger inner diameter ($ID_2$) that enables access by a kick-over tool above the pocket to selectively install the gas lift valve in or to retrieve the gas lift valve from the pocket.

2. The side pocket mandrel of claim 1, wherein in its ($P_1$) position, the movable curtain is dimensioned and configured to allow a metal cylinder used as part of a plunger lift system to pass along the side pocket mandrel without catching on the pocket.

3. The side pocket mandrel of claim 2, wherein:

each of the first and second opposing ends of the tubular body is configured to threadedly connect to a joint of production tubing;

the upper end of the tubular body comprises an orienting sleeve configured to catch a guide key of a kick-over tool when the kick-over tool is raised across the side pocket mandrel, thereby orienting the kick-over tool towards the eccentric portion; and a length of the pocket is less than a length of the eccentric portion, preserving an open area within the eccentric portion above the pocket that is configured to receive a gas lift valve during the installation or the retrieval.

4. The side pocket mandrel of claim 3, wherein:

the pocket is placed within the eccentric portion such that an open area is further preserved below the pocket; and the side pocket mandrel further comprises a stationary curtain disposed along the open area below the pocket, wherein an upper end of the stationary curtain resides adjacent to a bottom of the pocket while a lower end of the stationary curtain is fixed to a lower end of the tubular body, thereby reducing the inner diameter of the open area below the pocket to approximately ($ID_1$).

5. The side pocket mandrel of claim 4, wherein:

each of the movable curtain and the stationary curtain is fabricated from a metal material.

6. The side pocket mandrel of claim 3, wherein the movable curtain comprises:

an upper end pinned to the tubular body proximate an upper end of the eccentric portion; and a lower end configured to flex in response to a lateral force initiated by the kick-over tool during the installation or the retrieval, thereby permitting access to an upper end of the pocket during the installation or the retrieval.

7. The side pocket mandrel of claim 6, wherein the movable curtain comprises:

a bow spring configured to flex within the recessed portion such that at least a lower end of the bow spring moves from ($ID_1$) to ($ID_2$) in response to the lateral force during the installation or the retrieval.

8. The side pocket mandrel of claim 6, wherein the movable curtain comprises:

a top end pivotally pinned to the tubular body proximate an upper end of the eccentric portion; and a bottom end that flexes inward towards the tubular body from ($ID_1$) to ($ID_2$) in response to the lateral force during the installation or the retrieval.

9. The side pocket mandrel of claim 8, wherein upon flexing, either:

the bottom end of the movable curtain is configured to clear the upper end of the pocket to allow for the flexure; or the bottom end of the movable curtain extends beyond the upper end of the pocket, but comprises an opening that passes across the upper end of the pocket to allow for the flexure.

10. The side pocket mandrel of claim 6, wherein:

the pocket is placed within the eccentric portion such that an open area is further left below the pocket; and the side pocket mandrel further comprises a stationary curtain disposed along the open area below the pocket, wherein an upper end of the stationary curtain is fixed to a bottom of the pocket while a lower end of the stationary curtain is fixed to a lower end of the tubular body, thereby reducing the inner diameter of the open area below the pocket to approximately ($ID_1$).

11. The side pocket mandrel of claim 3, wherein:

a shoulder is formed along the tubular body where the upper end of the tubular body meets the eccentric portion;

the shoulder comprises a slot; and the movable curtain comprises an elongated body having an upper end and a lower end, wherein the movable curtain is configured to move upward through the slot in the shoulder tool in response to an upward force provided by the kick-over tool when the kick-over tool is raised across the eccentric portion.

12. The side pocket mandrel of claim 11, wherein:

the elongated body of the movable curtain comprises a concave profile;

the movable curtain is configured to be moved upward through the slot upon contact with a knob of the kick-over tool when the kick-over tool is raised across the eccentric portion, thereby exposing the eccentric portion of the tubular body as ($ID_2$); and the movable curtain is configured to gravitationally fall through the slot and back into the eccentric portion when the kick-over tool is raised back out of the side pocket mandrel.

13. An artificial lift system for a wellbore, the wellbore having a tubing string for conveying production fluids up to a surface, and the artificial lift system comprising:

a plunger lift system comprising:

a lubricator at the surface, a cylinder dimensioned to travel through the production tubing upon being released from a catcher in the lubricator; and a bumper residing in the production tubing and configured to receive the cylinder when it travels towards the bottom of the wellbore; and at least one side pocket mandrel disposed along the production tubing, wherein each side pocket mandrel comprises:

a tubular body having an upper end, an opposing lower end, and a bore formed within the tubular body in fluid communication with the production tubing, and wherein the tubular body comprises an eccentric portion residing between the upper and lower ends such that a first inner diameter ($ID_1$) is formed at the opposing upper and lower ends, and a second larger inner diameter ($ID_2$) is formed along the eccentric portion;

a tubular pocket residing within the eccentric portion of the tubular body, wherein each tubular pocket holds a gas lift valve;

one or more ports disposed within the tubular body adjacent the pocket, placing the pocket in fluid communication with an annular region around the production tubing; and a movable curtain disposed along the eccentric portion, wherein in a first position ($P_1$) the movable curtain covers a portion of the eccentric portion above the pocket to provide a reduced inner diameter that approximates ($ID_1$), and in a second position ($P_2$) the movable curtain is movable to a larger inner diameter ($ID_2$) that enables access by a kick-over tool above the pocket to selectively install the gas lift valve in or to retrieve the gas lift valve from the pocket.

14. The artificial lift system of claim 13, wherein:

in its ($P_1$) position, the movable curtain is dimensioned and configured to allow the metal cylinder used as part of the plunger lift system to pass along the side pocket mandrel without catching on the pocket; and the at least one side pocket mandrel comprises at least two side pocket mandrels.

15. The artificial lift system of claim 14, wherein:

each of the first and second opposing ends of the tubular body is configured to threadedly connect to an adjoining joint of production tubing;

the upper end of the tubular body comprises an orienting sleeve configured to catch a guide key of a kick-over tool when the kick-over tool is raised across the side pocket mandrel, thereby orienting the kick-over tool towards the eccentric portion; and a length of the pocket is less than a length of the eccentric portion, preserving an open area within the eccentric portion above the pocket that is configured to receive a gas lift valve during the installation or the retrieval.

16. The artificial lift system of claim 15, wherein:

the pocket is placed within the eccentric portion such that an open area is further preserved below the pocket; and the side pocket mandrel further comprises a stationary curtain disposed along the open area below the pocket, wherein an upper end of the stationary curtain is adjacent to a bottom of the pocket while a lower end of the stationary curtain is fixed to a lower end of the tubular body, thereby reducing the inner diameter of the open area below the pocket to approximately ($ID_1$).

17. The artificial lift system of claim 16, wherein:

each of the movable curtain and the stationary curtain is fabricated from a metal material.

18. The artificial lift system of claim 15, wherein the movable curtain comprises:

an upper end pinned to the tubular body proximate an upper end of the eccentric portion; and a lower end configured to flex in response to a lateral force initiated by the kick-over tool during the installation or the retrieval, thereby permitting access to an upper end of the pocket during the installation or the retrieval.

19. The artificial lift system of claim 17, wherein the movable curtain comprises:

a top end pivotally pinned to the tubular body proximate an upper end of the eccentric portion; and a bottom end that flexes inward towards the tubular body from ($ID_1$) to ($ID_2$) in response to a force initiated by the kick-over tool during the installation or the retrieval;

and wherein upon flexing, either:

the bottom end of the movable curtain is configured to clear the upper end of the pocket to allow for the flexure; or the bottom end of the movable curtain extends beyond the upper end of the pocket, but comprises an opening that passes across the upper end of the pocket to allow for the flexure.

20. The artificial lift system of claim 15, wherein:

a shoulder is formed along the tubular body where the upper end of the tubular body meets the eccentric portion;

the shoulder comprises a slot; and the movable curtain comprises an elongated body having an upper end and a lower end, wherein the movable curtain is configured to move upward through the slot in the shoulder in response to an upward force provided by the kick-over tool when the kick-over tool is raised across the eccentric portion.

21. The side pocket mandrel of claim 20, wherein:

the elongated body of the movable curtain comprises a concave profile;

the movable curtain is configured to be moved upward through the slot upon contact with a knob of the kick-over tool when the kick-over tool is raised across the eccentric portion, thereby exposing the eccentric portion of the tubular body as ($ID_2$); and the movable curtain is configured to gravitationally fall through the slot and back into the eccentric portion when the kick-over tool is raised back out of the side pocket mandrel.

22. A method of producing hydrocarbon fluids from a wellbore, wherein the wellbore comprises a wellhead at a surface, and at least one string of casing extending down from the wellhead, and the method comprises:

running a string of production tubing into the wellbore, wherein the string of production tubing comprises:

a series of tubing joints threadedly connected end-to-end; and at least two side pocket mandrels threadedly connected along the production tubing, wherein each side pocket mandrel comprises:

a tubular body having an upper end, an opposing lower end, and a bore formed within the tubular body in fluid communication with the production tubing, and wherein the tubular body comprises an eccentric portion residing between the upper and lower ends such that a first inner diameter ($ID_1$) is formed at the opposing upper and lower ends, and a second larger inner diameter ($ID_2$) is formed along the eccentric portion;

a tubular pocket residing within the eccentric portion of the tubular body, the tubular pocket being dimensioned to slidably receive a gas lift valve;

one or more ports disposed within the tubular body adjacent the pocket, placing the pocket in fluid communication with an annular region around the production tubing; and a movable curtain disposed along the eccentric portion, wherein in a first position ($P_1$) the movable curtain covers a portion of the eccentric portion above the pocket to provide a reduced inner diameter that approximates ($ID_1$), and in a second position ($P_2$) the movable curtain is movable to a larger inner diameter ($ID_2$) that enables access by a kick-over tool above the pocket to selectively install the gas lift valve in or to retrieve the gas lift valve from the pocket; and producing hydrocarbon fluids from a subsurface reservoir, through the production tubing, and up to the wellhead at the surface.

23. The method of claim 22, wherein:

in its ($P_1$) position, the movable curtain is dimensioned and configured to allow a metal cylinder used as part of a plunger lift system to pass along the side pocket mandrel without catching on the pocket; and the method further comprises:

releasing the metal cylinder from a lubricator disposed over the wellhead into the wellbore; and allowing the metal cylinder to gravitationally fall to a bumper spring positioned along the production tubing below the at least two side pocket mandrels.

24. The method of claim 23, wherein:

each of the first and second opposing ends of the tubular body is configured to threadedly connect to an adjoining joint of production tubing;

the upper end of the tubular body comprises an orienting sleeve configured to catch a guide key of a kick-over tool when the kick-over tool is raised across the side pocket mandrel, thereby orienting the kick-over tool towards the eccentric portion; and a length of the pocket is less than a length of the eccentric portion, preserving an open area within the eccentric portion above the pocket that is configured to receive a gas lift valve during the installation or the retrieval.

25. The method of claim 24, wherein:

the pocket is placed within the eccentric portion such that an open area is further preserved below the pocket; and the side pocket mandrel further comprises a stationary curtain disposed along the open area below the pocket, wherein an upper end of the stationary curtain is adjacent to a bottom of the pocket while a lower end of the stationary curtain is fixed to a lower end of the tubular body, thereby reducing the inner diameter of the open area below the pocket to approximately ($ID_1$).

26. The method of claim 25, wherein:

each of the movable curtain and the stationary curtain is fabricated from a metal material.

27. The method of claim 24, wherein the movable curtain comprises:

an upper end pinned to the tubular body proximate an upper end of the eccentric portion; and a lower end configured to move in response to a force initiated by the kick-over tool during the installation or the retrieval.

28. The method of claim 24, wherein the movable curtain comprises:

a top end pivotally pinned to the tubular body proximate an upper end of the eccentric portion; and a bottom end that flexes inward towards the tubular body from ($ID_1$) to ($ID_2$) in response to a force initiated by the kick-over tool during the installation or the retrieval;

and wherein upon flexing, either:

the bottom end of the movable curtain is configured to clear the upper end of the pocket to allow for the flexure; or the bottom end of the movable curtain extends beyond the upper end of the pocket, but comprises an opening that passes across the upper end of the pocket to allow for the flexure.

29. The method of claim 24, wherein:

a shoulder is formed along the tubular body where the upper end of the tubular body meets the eccentric portion;

the shoulder comprises a slot; and the movable curtain comprises an elongated body having an upper end and a lower end, wherein the movable curtain is configured to move upward through the slot in the kick-over tool in response to an upward force provided by the kick-over tool when the kick-over tool is raised across the eccentric portion.

30. The method of claim 29, wherein:

the movable curtain is configured to be moved upward through the slot upon contact with a knob of the kick-over tool when the kick-over tool is raised across the eccentric portion; and the movable curtain is configured to gravitationally fall through the slot and back into the eccentric portion when the kick-over tool is raised back out of the side pocket mandrel.

* * * * *